US008081116B2

(12) United States Patent
Yoshioka

(10) Patent No.: US 8,081,116 B2
(45) Date of Patent: Dec. 20, 2011

(54) BROADBAND ANTENNA UNIT COMPRISING A FOLDED PLATE-SHAPED MONOPOLE ANTENNA PORTION AND AN EXTENDING PORTION

(75) Inventor: Hiroki Yoshioka, Tokyo (JP)

(73) Assignee: Mitsumi Electric Co., Ltd., Tama-shi (JP)

( * ) Notice: Subject to any disclaimer, the term of this patent is extended or adjusted under 35 U.S.C. 154(b) by 835 days.

(21) Appl. No.: 12/069,332

(22) Filed: Feb. 8, 2008

(65) Prior Publication Data

US 2008/0198075 A1 Aug. 21, 2008

(30) Foreign Application Priority Data

Feb. 20, 2007 (JP) ..... 2007-038737
Jul. 31, 2007 (JP) ..... 2007-200132

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,069,592 A 5/2000 Wass
6,535,170 B2 3/2003 Sawamura et al.
6,847,328 B1 * 1/2005 Libonati et al. ..... 343/700 MS
6,914,561 B2 7/2005 Kuroda et al.
7,081,859 B2 7/2006 Miyoshi et al.
7,417,588 B2 8/2008 Castany et al.
2002/0175865 A1 11/2002 Cassel et al.
2004/0012530 A1 1/2004 Chen
2005/0243007 A1 11/2005 Ke et al.
2005/0275594 A1 12/2005 Zhang et al.
2006/0017620 A1 1/2006 Chen et al.
2007/0176833 A1 * 8/2007 Haho et al. ..... 343/702
2008/0036666 A1 * 2/2008 Shih ..... 343/702

FOREIGN PATENT DOCUMENTS

JP 11-68453 A 3/1999

(Continued)

OTHER PUBLICATIONS

S. Hattori et al; An Elliptically Shaped Ring Broadband Antenna; 2005; B-1-104; Faculty of Engineering, Hosei University; p. 104.

(Continued)

*Primary Examiner* — Douglas W. Owens
*Assistant Examiner* — Dieu H Duong
(74) *Attorney, Agent, or Firm* — Holtz, Holtz, Goodman & Chick PC

(57) ABSTRACT

In a broadband antenna unit including a ground plate, an antenna element disposed in the vicinity of an end of the ground plate, and a dielectric substrate for mounting the antenna element therein, the antenna element includes a folded plate-shaped monopole antenna portion having a U-shape in cross section and an extending portion extending from the folded plate-shaped monopole antenna portion. The antenna element is disposed on the side of one side edge of the ground plate. The broadband antenna unit has a feeding point between the ground plate and the antenna element that is disposed at a feeding position apart from the one side by a predetermined distance. A ratio between a width of the ground plate and the predetermined distance is substantially 5:2 when a ratio between the width of the ground plate and a width of the folded plate-shaped monopole antenna portion is 2:1.

9 Claims, 24 Drawing Sheets

FOREIGN PATENT DOCUMENTS

| | | | |
|---|---|---|---|
| JP | 2002-185238 | A | 6/2002 |
| JP | 2003-273638 | A | 9/2003 |
| JP | 2003-283233 | A | 10/2003 |
| JP | 2003-304114 | A | 10/2003 |
| JP | 2003-304115 | A | 10/2003 |
| JP | 2005-94437 | A | 4/2005 |
| WO | WO 97/49141 | A1 | 12/1997 |
| WO | WO 02/091520 | A1 | 11/2002 |
| WO | WO 2005/011051 | A2 | 2/2005 |
| WO | WO 2005/076409 | A1 | 8/2005 |

OTHER PUBLICATIONS

S. Hattori et al; An Elliptically Shaped Ring Broadband Antenna—Part II; 2005; B-1-82; Wireless Network Communications Research Center, Graduate School of Engineering, Hosei University; p. 82.

S. Hattori et al; An Elliptically Shaped Ring Broadband Antenna—Part III; 2005; B-1-165; Wireless Network Communications Research Center, Graduate School of Engineering, Hosei University; p. 165.

European Office Action dated Mar. 1, 2010 and English translation thereof in counterpart European Application No. 18 101 773.3-1248.

Kin-Lu Wong et al., "Wideband Internal Folded Planar Monopole Antenna for UMTS/WiMAX Folder-Type Mobile Phone", Microwave and Optical Technology Letters, vol. 48, No. 2, Feb. 2006, pp. 324-327, XP002482111.

English Language extended European Search Report dated Jun. 11, 2008 issued in counterpart European Appln. No. EP 08101773.3.

European Office Action dated Mar. 1, 2010 (in English) in counterpart European Application No. 08 101 773.3-1248.

* cited by examiner

BROADBAND ANTENNA UNIT COMPRISING A FOLDED PLATE-SHAPED MONOPOLE ANTENNA PORTION AND AN EXTENDING PORTION

This application is based upon and claims the benefit or priority from Japanese patent application No. 2007-38737, filed on Feb. 20, 2007, and Japanese patent application No. 2007-200132, filed on Jul. 31, 2007, the disclosures of which are incorporated herein their entirety by reference.

BACKGROUND OF THE INVENTION

This invention relates to a broadband antenna unit and, more particularly, to a broadband antenna unit included in a mobile equipment terminal and an antenna element for use in it.

An ultra wideband (UWB) technology means an ultra wideband radio technology like its name and is defined as any radio technology having a spectrum that occupies a bandwidth greater than 25 percent of the center frequency, or a bandwidth of at least 1.5 GHz. In a word, the UWB technology is technology for communicating using short pulses (normally each having a pulse width of 1 ns or less) of ultra wideband so as to start a revolution in radio technology.

A crucial difference between a conventional radio technology and the UWB technology is the presence or absence of a carrier wave. The conventional radio technology modulates a sinusoidal wave having a frequency called the carrier wave using various methods to transmit and receive data. On the other hand, the UWB technology does not use the carrier wave. In the manner which is written in definition of the UWB technology, the UWB technology uses the short pulses of the ultra wideband.

Like its name, the UWB technology has a frequency band of the ultra wideband. On the other hand, the conventional radio technology has only a narrow frequency band. This is because it is possible, with the narrow frequency band, to effectively utilize electric waves. The electric waves are finite resources. The reason why the UWB technology is widely noticed in spite of the ultra wideband is output energy of each frequency. The UWB technology has a very small output at each frequency although a frequency band is wide. Inasmuch as the output of the UWB technology has such a magnitude as to be covered with noises, the UWB technology reduces interference with other wireless spectra. In the United States, the Federal Communications Commission (FCC) has mandated that UWB radio transmissions can legally operate in a range from 3.1 GHz to 10.6 GHz, at a limited transmit power of −4.1 dBm/MHz.

In addition, antennas basically use a resonance phenomenon. The antenna has a resonance frequency which is determined by its length. However, it is difficult for the UWB including a lot of frequency components to make the antenna for UWB resonate. Accordingly, the wider the frequency band of the electric wave to be transmitted is, the more difficult it is to make a plan or design for the antenna for UWB.

Taiyo Yuden Co. Ltd. has successfully developed a very miniaturized ceramic chip antenna having a size of 10×8×1 mm for ultra wideband applications. Since UWB technology was released by the FCC commercial use, it has been hailed as the short-range wires-communication standard of the future. For one thing, it promises to simultaneously provide a high data rate and low power consumption. By sending very low-power pulses below the transmission-noise threshold, UWB also avoids interference. By developing the antenna, it has become the responsibility of the wireless industry to help UWB make the transition from military applications to widespread commercial use for connecting at a very high speed data between digital devices such as PDP (plasma display panel) television, a digital camera, or the like.

In addition, such a UWB antenna can be used for various purposes such as Bluetooth (registered trademark), wireless LAN (local area network), or the like.

Bluetooth (registered trademark) technology is a cutting-edge open specification that enables short-range wireless connections between desktop and notebook computers, handhelds, personal digital assistants, mobile phones, camera phones, printers, digital cameras, handsets, keyboards and even a computer mouse. Bluetooth wireless technology uses a globally available frequency band (2.4 GHz) for worldwide compatibility. In a nutshell, Bluetooth technology unplugs your digital peripherals and makes cable clutter a thing of the past.

The wireless LAN is an LAN using a transmission path except for a wire cable, such as electric waves, infrared rays, or the like.

Various broadband antenna devices are already known in the art. By way of example, JP 2003-273638 A discloses a wideband antenna device with which interference to be exerted by an unwanted frequency band or a frequency band out of a target is reduced by forming the wideband antenna device matched with target frequency characteristics. According to JP 2003-273638 A, the wideband antenna device comprises a flat conductive ground plate and a flat radiation conductor standing up above a plane of the flat conductive ground plate in a direction to intersect the flat conductive ground plate. The wideband antenna device has a feeding point on or near an outer peripheral portion of the flat radiation conductor. The flat radiation conductor has one or more notches formed by cutting a part of the flat radiation conductor.

In addition, JP 2003-283233 A discloses a wideband antenna device with a wide band and a small size that counters the problems in costs, usage purposes or mounting on equipment and that is capable of cutting manufacturing costs. According to JP 2003-283233 A, the wideband antenna device comprises a flat conductive ground plate and a polygonal flat radiation conductor standing up above a plane of the flat conductive ground plate in a direction to intersect the flat conductive ground plate. The polygonal flat radiation conductor has a top which is used as a signal feeding point.

Furthermore, JP 2003-304114 A discloses a wideband antenna device which uses a plate-shaped radiation conductor as a radiation conductor and which can be made more compact. According to JP 2003-304114 A, the wideband antenna device comprises a flat conductive ground plate and a flat radiation conductor standing up above a plane of the flat radiation ground plate in a direction to intersect the flat conductive ground plate. In a state where the flat radiation conductor stands up above the plane of the flat conductive ground plate, the flat radiation conductor comprises a plurality of conductive portions so as to be arranged in the direction to intersect the flat conductive ground plate. Through a low conductivity member having conductivity of almost 0.1 [/Ωm] or more and 10.0 [/Ωm] or less, the plurality of conductive portions are connected.

In the wideband antenna devices disclosed in the above-mentioned JP 2003-273638 A, JP 2003-283233 A, and JP 2003-304114 A, the flat radiation conductor stands up above the plane of the flat conductive ground plate in the direction to intersect the flat conductive ground plate. Therefore, the wideband antenna devices are high in profile and it is difficult to include the wideband antenna device in a portable equipment terminal. In addition, in the above-mentioned JP 2003-304114 A, the disclosed wideband antenna device has a low limit frequency of 2.32 GHz and cannot support a frequency lower than the low limit frequency.

A thin-type wideband antenna device is disclosed in JP 2003-304115 A which corresponds to U.S. Pat. No. 6,914,561 issued to Shinichi Kuroda et al. According to JP 2003-304115 A, the thin-type wideband antenna device includes a reference conductor (conductive ground plate) and a radiation conductor that are connected with a feeder line for transmitting power, at least parts of which are disposed so as to face each other. Interposed between the parts that the reference conductor and the radiation conductor face each other, a substance has conductivity which is about 0.1 [/Ωm] through 10 [/Ωm] in the operational radio frequency.

However, the thin-type wideband antenna device disclosed in JP 2003-304115 A is disadvantageous in that an operable band is narrow.

On the other hand, an ultra wideband (UWB) antenna unit which is capable of widening the band and which is capable of improving a frequency characteristic has already been proposed in JP 2005-94437 A which corresponds to U.S. Pat. No. 7,081,859 issued to Akira Miyoshi et al. According to JP 2005-94437 A, the UWB antenna unit comprises an upper dielectric, a lower dielectric, and a conductive pattern sandwiched therebetween. The conductive pattern has a feeding point at a substantially center portion of a front surface. The conductive pattern comprises a reversed triangular portion having a right-hand taper part and a left-hand taper part which widen from the feeding point at a predetermined angle toward a right-hand side surface and a left-hand side surface, respectively, and a rectangular portion having a base side being in contact with an upper side of the reversed triangular portion. In addition, the feeding point of the conductive pattern is electrically connected to a ground plate which extends in a plane similar to that of the conductive pattern (a radiation element).

Inasmuch as the UWB antenna unit disclosed in JP 2005-94437 A has a usable frequency band which lies between about 4 GHz and about 9 Hz. Therefore, the usable frequency band is narrow.

Various thin UWB antennas which cover a UWB band between 3.1 GHz and 10.6 GHz are proposed in the art. By way of example, an elliptically shaped ring broadband antenna is reported by Satoshi Hattori et al in a first paper contributed to 2005 National Convention of the Institute of Electronics, Information and Communication Engineers of Japan as Paper No. B-1-104, Osaka, Japan, May, 2005, under the title of "An Elliptically Shaped Ring Broadband Antenna." In the elliptically shaped ring broadband antenna reported in the first paper, an elliptically shaped radiation element has an outside diameter in a major axis direction of 24 mm and a ground plate has a square with a side of 45 mm.

Another elliptically shaped ring broadband antenna is reported by Satoshi Hattori et al in a second paper contributed to 2005 Communication Society Convention of the Institute of Electronics, Information and Communication Engineers of Japan as Paper No. B-1-82, Hokkaido, Japan, September, 2005, under the title of "An Elliptically Shaped Ring Broadband Antenna—Part II." The elliptically shaped ring broadband antenna reported in the second paper comprises a ground plate having a semi-elliptically shaped upper edge.

Still another elliptically shaped ring broadband antenna is reported by Satoshi Hattori et al in a third paper contributed to 2006 National Convention of the Institute of Electronics, Information and Communication Engineers of Japan as Paper No. B-1-165, Tokyo, Japan, May, 2006, under the title of "An Elliptically Shaped Ring Broadband Antenna—Part III." The elliptically shaped ring broadband antenna reported in the third paper comprises a ground plate having a lower portion where both side corner portions are deleted with a central portion left. With this structure, it is possible to improve a gain in a +z direction at or more than a frequency of 9 GHz.

The elliptically shaped ring broadband antennas reported in the first through the third papers cover the UWB band between 3.1 GHz and 10.6 GHz. However, it is difficult to cover a frequency band lower than the UWB band, for example, a frequency band (2.45 GHz band) for use in the wireless LAN, a frequency of 1.575 GHz for use in a global positioning system (GPS), or a frequency band (e.g. 2.1 GHz band) for use in a cellular telephone.

In addition, various antenna devices included in portable wireless terminals are already known in the art. By way of example, a dual band built-in antenna device is disclosed in JP 2002-185238 A which corresponds to U.S. Pat. No. 6,535,170 issued to Masatoshi Sawamura et al. The dual band built-in antenna device disclosed in JP 2002-185238 A is operable in a first frequency band and a second frequency band. The dual band built-in antenna device comprises a ground plane comprising a ground member, a first inverted-L line antenna element for the first frequency band, and a second inverted-L antenna element for the second frequency band. The first and the second inverted-L line antenna elements are so constructed that the elements are extended in respective directions further away from each other as the antenna elements extend further from a starting position set in proximity to a power feed point within a plane parallel to the ground plane. The dual band built-in antenna device further comprises a matching circuit shared with the first and the second inverted-L line antenna elements.

In JP 2002-185238 A, as mobile wireless terminals comprising such dual band built-in antenna devices, following multiplex terminals are intended (targeted). A multiplex terminal which can jointly use PDC (Personal Digital Cellular) operation on 800 MHz band and PHS (Personal Handyphone System) operation on 1.9 GHz has been made commercially availably in Japan. Another multiplex terminal capable of jointly using GSM (Global System for Mobile Communication) operation on 900 MHz band and DCS (Digital Communication System) operation on 1.8 GHz has also been on the market in Europe and Asian countries. Moreover, another multiplex terminal which can operate on both AMPS (Advanced Mobile telephone Service) using 800 MHz band and PCS (Personal Communication Service) using 1.9 GHz band has been on sale in the United States.

JP 11-68453 A proposes a composite antenna which has a small external size and which can easily obtain a desired feeding point impedance. The composite antenna disclosed in JP 11-68453 A comprises plural nearly U-shaped folded antennas corresponding to plural frequency bands. Each U-shaped folded antenna includes a main element having one end as a feeding point and a sub-element folded from another end of the main element. The sub-element has an opened end. The main elements of the U-shaped folded antenna are integrated to reduce the external size of the composite antenna. In JP 11-68453 A, a low frequency band is 860 MHz band while a high frequency band is 1900 MHz band.

The antenna devices disclosed in JP 2002-185238 A and JP 11-68453A only cover the low frequency band between 800 MHz and 900 MHz and the high frequency band between 1.8 GHz and 2.0 GHz. Accordingly, the antenna devices disclosed in JP 2002-185238 A and JP 11-68453A are disadvantageous in that it is impossible to cover the above-mentioned UWB band.

SUMMARY OF THE INVENTION

It is therefore an exemplary object of the present invention to provide a broadband antenna unit which is capable of covering not only a frequency band for use in a wireless LAN and a frequency band for UWB but also a frequency band for use in cellular telephone and a frequency for use in GPS.

It is another exemplary object of the present invention to provide a broadband antenna unit having a low profile (height) which is capable of being included in a mobile equipment terminal.

Other objects of this invention will become clear as the description proceeds.

According to a first exemplary aspect of this invention, an antenna element comprises a folded plate-shaped monopole antenna portion having a U-shape in cross section and an extending portion extending from the folded plate-shaped monopole antenna portion.

According to a second exemplary aspect of this invention, a broadband antenna unit comprises a ground plate, an antenna element disposed in the vicinity of an end of the ground plate, and a dielectric substrate for mounting the antenna element thereon. The antenna element comprises a folded plate-shaped monopole antenna portion having a U-shape in cross section and an extending portion extending from the folded plate-shaped monopole antenna portion.

According to a third exemplary aspect of this invention, a broadband antenna unit comprises a first ground plate, a second ground plate, an antenna element disposed between the first ground plate and the second ground plate in the vicinity of an end of the ground plate, and a dielectric substrate for mounting the antenna element thereon. The antenna element comprises a folded plate-shaped monopole antenna portion having a U-shape in cross section and an extending portion extending from the folded plate-shaped monopole antenna portion.

DESCRIPTION OF THE PREFERRED EMBODIMENTS

Figure 1:
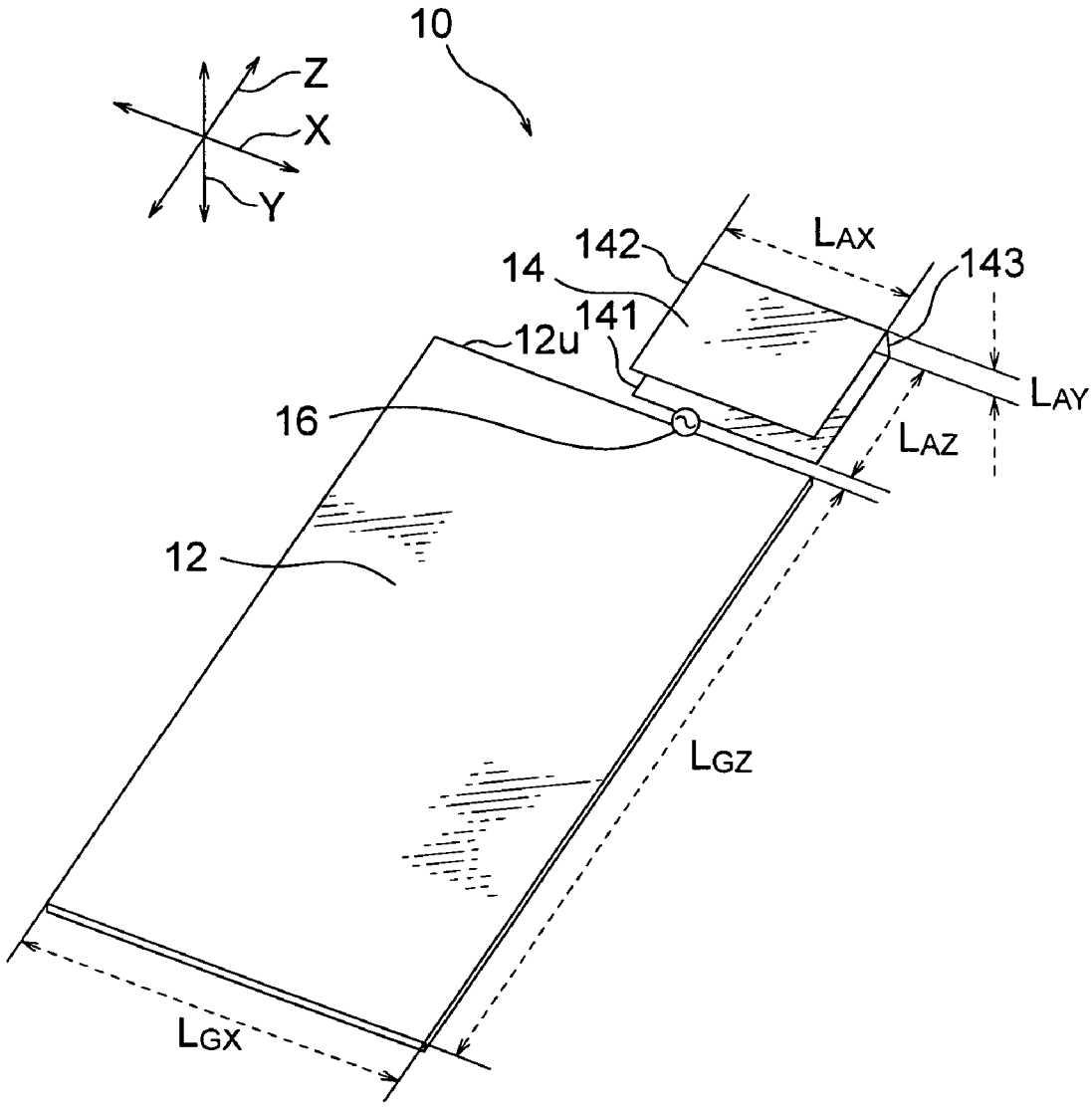
FIG. 1 RELATED ART
FIG. 1 is a schematic perspective view showing a first related art antenna unit.
Figure 2:
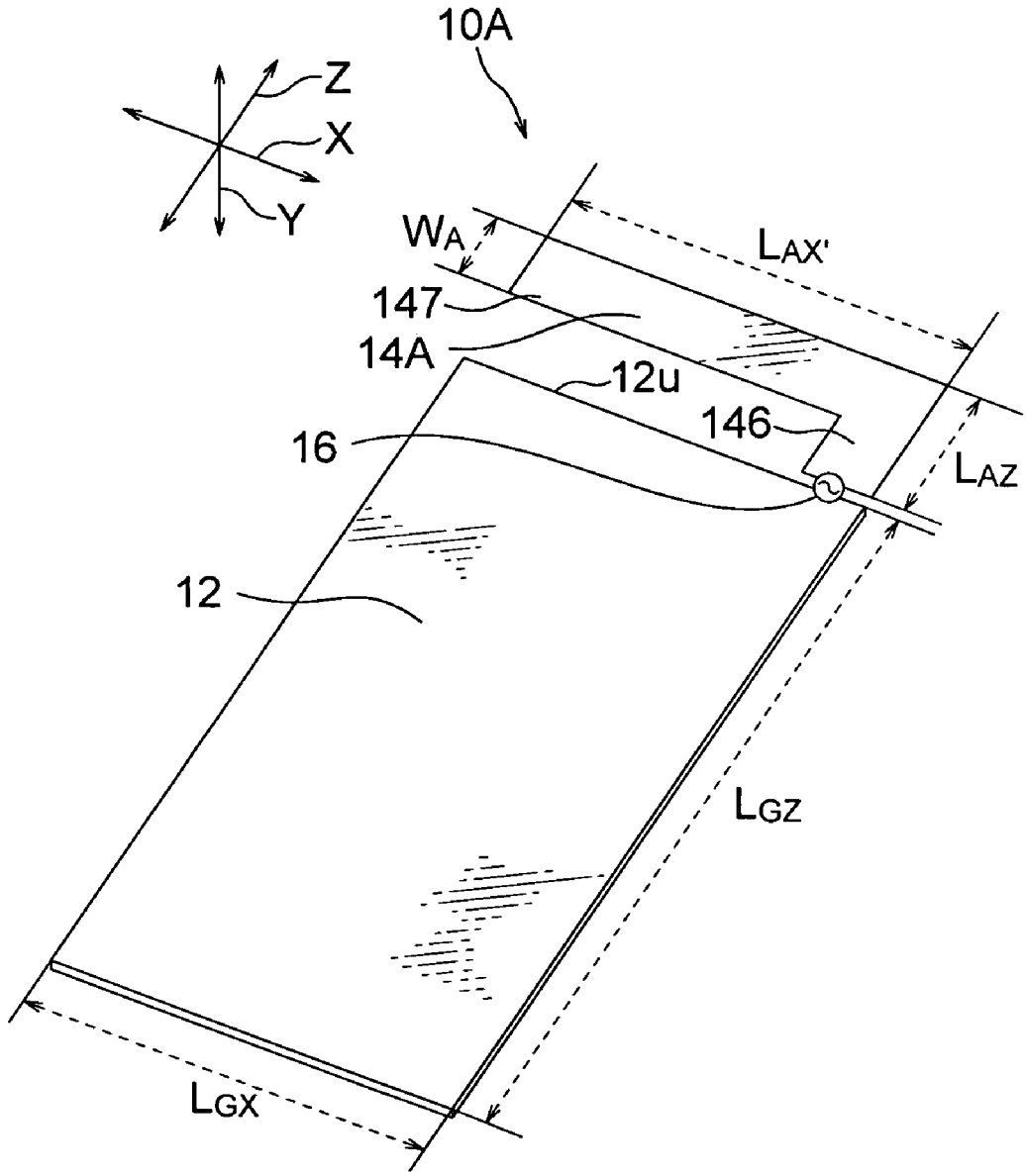
FIG. 2 RELATED ART
FIG. 2 is a schematic perspective view showing a second related art antenna unit.

Referring to FIGS. 1 and 2, first and second related art antenna units 10 and 10A will be described at first in order to facilitate an understanding of the present invention. FIG. 1 is a schematic perspective view showing the first related art antenna unit 10 while FIG. 2 is a schematic perspective view showing the second related art antenna unit 10A. In FIGS. 1 and 2, a left-and-right direction (a width direction, a horizontal direction) is represented by an X-axis direction, a fore-and-aft direction (a depth direction, a thickness direction) is represented by a Y-axis direction, and an up-and-down direction (a height direction, a vertical direction) is represented by a Z-axis direction.

The first related art antenna unit 10 illustrated in FIG. 1 comprises a folded plane-shaped monopole antenna (FPMA) while the second related art antenna unit 10A illustrated in FIG. 2 comprises an inverted-L antenna (ILA).

Referring now to FIG. 1, the description will proceed to the first related art antenna unit (the folded plane-shaped monopole antenna) 10. The first related art antenna unit 10 comprises a ground plate 12 and an antenna element 14.

The ground plate 12 has a rectangular shape which has an X-direction length (a width) of $L_{GX}$ and a Z-direction length (a height) of $L_{GZ}$. In the example being illustrated, the X-direction length (width) $L_{GX}$ is equal to 40 mm and the Z-direction length (height) $L_{GZ}$ is equal to 80 mm. That is, the ground plate 12 extends in parallel with a X-Z plane defined by the left-and-right direction (the horizontal direction) X and the up-and-down direction (the vertical direction) Z.

In the vicinity of an upper edge or end (an upper side) 12*u* of the ground plate 12, the antenna element 14 is disposed at a right and upper corner portion thereof. In other words, the antenna element 14 is disposed at the right and upper corner portion of the ground plate 12 with a predetermined gap (a feeding distance) apart from the ground plate 12. The antenna element 14 has a U-shape in cross section which has an X-direction length $L_{AX}$, a Z-direction length $L_{AZ}$, and a Y-direction length $L_{AY}$. That is, the antenna element 14 serves as a folded plate-shaped monopole antenna (FPMA) having the U-shape in cross section. In the example being illustrated, the X-direction length $L_{AX}$ is equal to 20 mm, the Z-direction length $L_{AZ}$ is equal to 15 mm, and the Y-direction length $L_{AY}$ is equal to 4 mm.

More specifically, the antenna element 14 comprises a first conductive plate 141 having a rectangular shape, a second conductive plate 142 having a rectangular shape, and a coupling plate 143. The first conductive plate 141 extends on a plane which is flush with the X-Z plate where the ground plate 12 extends. The second conductive plate 142 is disposed in parallel with the first conductive plate 141 and apart from the first conductive plate 141 by a thickness $L_{AY}$ of 4 mm in the thickness direction Y. The coupling plate 143 is for coupling the first conductive plate 141 with the second conductive plate 142 at a first end portion away from the ground plate 12. Each of the first conductive plate 141 and the second conductive plate 142 has the X-direction length $L_{AX}$ and the Z-direction length $L_{AZ}$. The first conductive plate 141, the second conductive plate 142, and the coupling plate 143 may be manufactured by a bend working of one metal plate.

As shown in FIG. 1, between the ground plate 12 and the antenna element 14, a feeding point 16 is disposed at a position apart from a right and upper corner of the ground plate 12 by a predetermined distance.

Referring now to FIG. 2, the description will proceed to the second related art antenna unit (the inverted-L antenna) 10A. The second related art antenna unit 10A is similar in structure to the first related art antenna unit 10 illustrated in FIG. 1 except those points which will later be described. The antenna element is therefore depicted at 14A.

The antenna element 14A is disposed in the vicinity of the upper edge or end (the upper side) 12*u* of the ground plate 12. The antenna element 14A has an inverted-L shape having a width $W_A$ that extends on a plane which is flush with the X-Z plate where the ground plate 12 extends. That is, the antenna element 14A acts as the inverted-L antenna (ILA). More specifically, the antenna element 14A comprises a first metal plate 146 and a second metal plate 147. The first metal plate 146 extends in the height direction Z by a Z-direction length $L_{AZ}$ with a predetermined gap (a feeding distance) apart from the right and upper corner portion of the ground plate 12. The second metal plate 147 extends from the first metal plate 146 at an end side away from the ground plate 12 in the right-and-left direction X in parallel with the ground plate 12 by an X-direction length $L_{AX'}$. In the example being illustrated, the width $W_A$ is equal to 7 mm, the Z-direction length $L_{AZ}$ is equal to 15 mm, and the X-direction length $L_{AX'}$ is equal to 40 mm.

As shown in FIG. 2, between the ground plate 12 and the antenna element 14A, the feeding point 16 is disposed at a position apart from a right and upper corner of the ground plate 12 by a predetermined distance.

Figure 3:
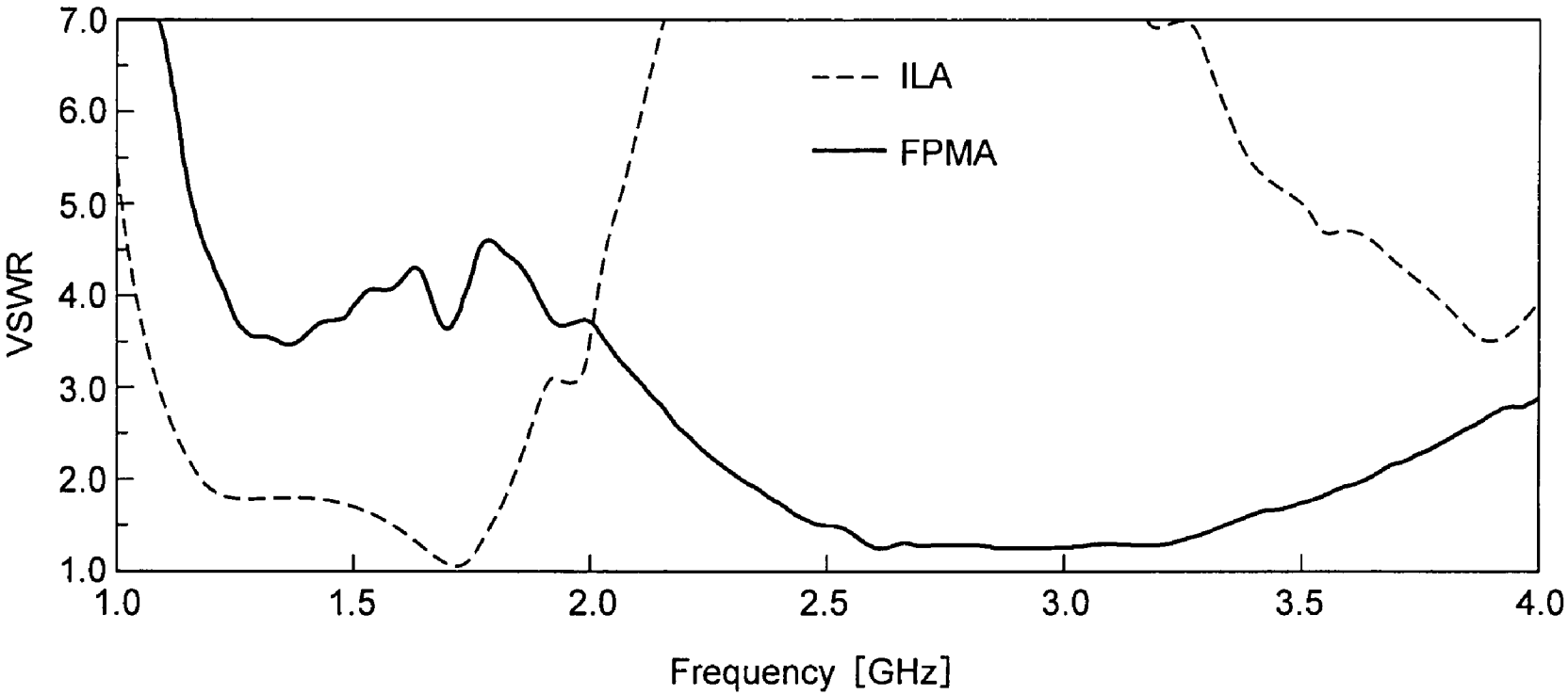
FIG. 3 RELATED ART
FIG. 3 is a view showing of frequency characteristics of VSWRs of the related art antenna units illustrated in FIGS. 1 and 2.

FIG. 3 shows frequency characteristics of voltage standing wave ratios (VSWRs) of the first related art antenna unit 10 illustrated in FIG. 1 and of the second related art antenna unit 10A illustrated in FIG. 2. The illustrated frequency characteristics of the VSWRs are analyzed by using the finite integral method. In FIG. 3, the abscissa represents a frequency [GHz] and the ordinate represents the VSWR. In FIG. 3, a solid line shows the frequency characteristic of the VSWR of the first related art antenna unit (FPMA) 10 while a broken line shows the frequency characteristic of the VSWR of the second related art antenna unit (ILA) 10A.

As seen in FIG. 3, it is understood that the first related art antenna unit (FPMA) 10 illustrated in FIG. 1 has the VSWR of 3 or less in a frequency range which is not less than 2.2 GHz and has the VSWR of 3 or more in a frequency range which is not more than 2.2 GHz. On the other hand, it is understood that the second related art antenna unit (ILA) 10A illustrated in FIG. 2 has the VSWR of 3 or less in a predetermined frequency range between about 1.1 GHz and about 1.9 GHz has the VSWR of 3 or more in a frequency range except for the predetermined frequency range.

From the above-mention, it is understood that the folded plate-shaped monopole antenna (FPMA) is available at a relatively higher frequency range while the inverted-L antenna (ILA) is available at a relatively lower frequency range.

The present inventor thinks that the frequency characteristic of a small VSWR in a wider frequency range may be obtained if the folded plate-shaped monopole antenna (FPMA) and the inverted-L antenna (ILA) are systematically coupled to take advantage of the respective antennas and, arrived at this invention ultimately. In addition, in the manner which will later become clear as the description proceeds, the present inventor verified that a feeding point must be set at an optimum position in order to obtain the frequency characteristic of a good VSWR.

There are mobile (cellular) telephones as a type of mobile equipment terminals. There are various types in the mobile telephone sets which are broadly divided into a straight type and a foldable type. The foldable type mobile telephone set comprises a lower unit having a console portion such as ten keys, an upper unit having a display portion, and a hinge portion for joining the lower unit to the upper unit for opening and closing. Inasmuch as the console portion and the display portion are mounted on different units in the foldable type mobile telephone set, the foldable type mobile telephone set has a relatively large size when it is put into an open state. On the other hand, the straight type mobile telephone set comprises a unit body on which a console portion and a display portion are mounted. As a result, the straight type mobile telephone set has a size which is about half that of the foldable type mobile telephone set which is put into the open state.

Figure 4:
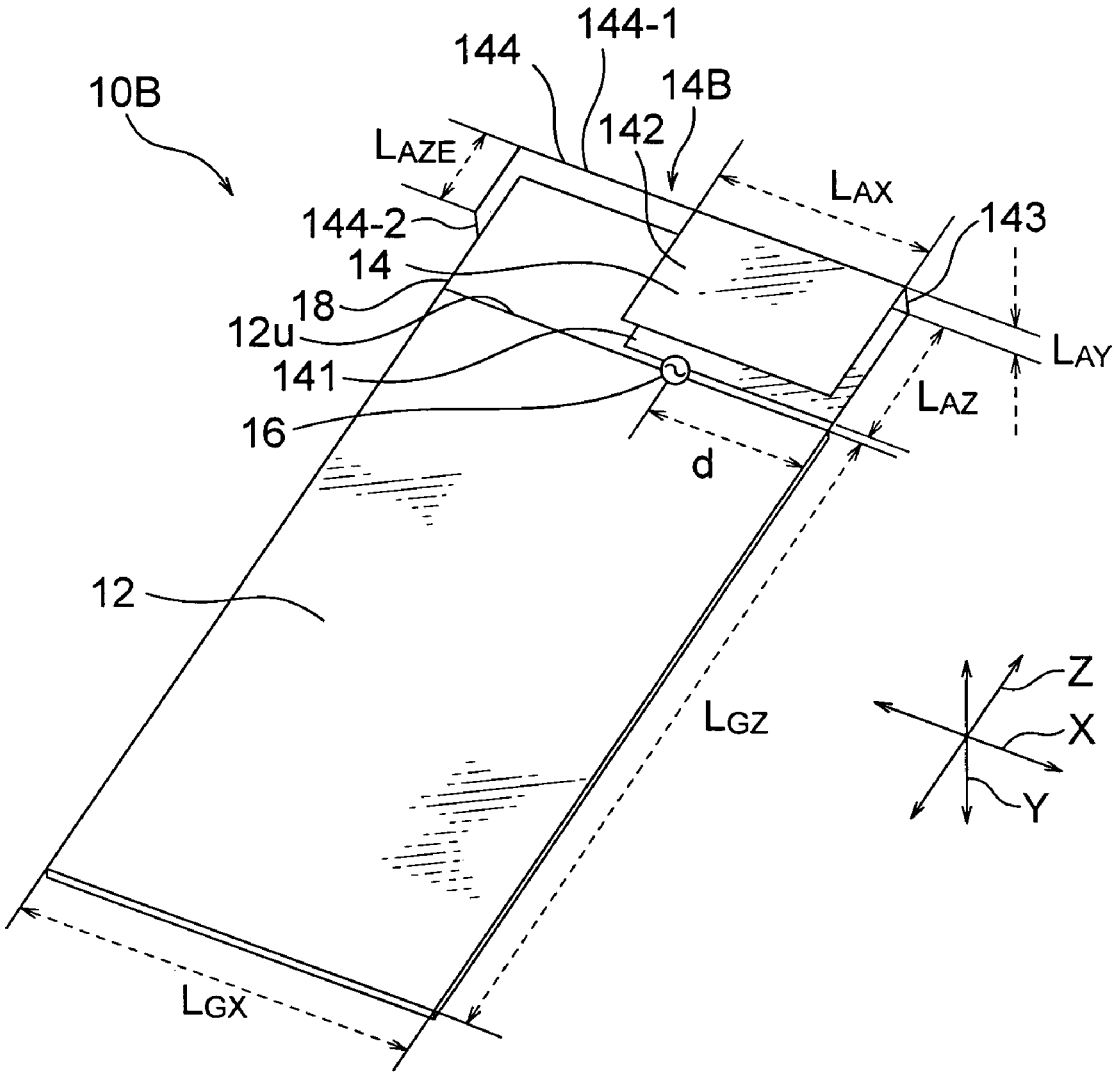
FIG. 4 is a schematic perspective view showing an ultra wideband antenna unit according to a first exemplary embodiment of this invention.

Referring to FIG. 4, the description will proceed to an ultra wideband antenna unit 10B according to a first exemplary embodiment of this invention. The illustrated ultra wideband antenna unit 10B is an antenna unit which can be included in the straight type mobile telephone set. The illustrated ultra wideband antenna unit 10B is similar in structure to the first related art antenna unit 10 illustrated in FIG. 1 except that the antenna unit is modified from that illustrated in FIG. 1 as will later become clear. The antenna unit is therefore depicted at 14B. Accordingly, similar reference symbols are attached to those having similar functions in FIG. 1 and the description therefore will be omitted for the sake of simplification of the description.

The illustrated antenna element 14B has structure where an L-shaped element (an inverted-L element) 144 is added to the antenna element (FPMA) 14 illustrated in FIG. 1. The L-shaped element 144 is called an extending portion because it extends from the coupling plate 143 leftward X. The L-shaped element 144 comprises a first extending portion 144-1 and a second extending portion 144-2. The first extending portion 144-1 extends in an extending direction (leftward) X where the coupling plate 143 extends. The second extending portion 144-2 extends from a tip of the first extending portion 144-1 toward the ground plate 12 downward Z by a length $L_{AZE}$. In the example being illustrated, the first extending portion 144-1 has a length ($L_{GX}$-$L_{AX}$) which is equal to 18 mm while the second extending portion 144-2 has the length $L_{AZE}$ which is equal to 9 mm. Accordingly, the extending portion 144 has a total length which is equal to 27 mm.

The antenna unit 14B is mounted on a dielectric substrate 18.

As shown in FIG. 4, disposed between the ground plate 12 and the antenna element 14, the feeding point 16 is located at a feeding position which is apart from the right and upper corner (the right-hand side edge) of the ground plate 12 by a predetermined distance d. Herein, the predetermined distance d is also called the feeding position.

Figure 5:
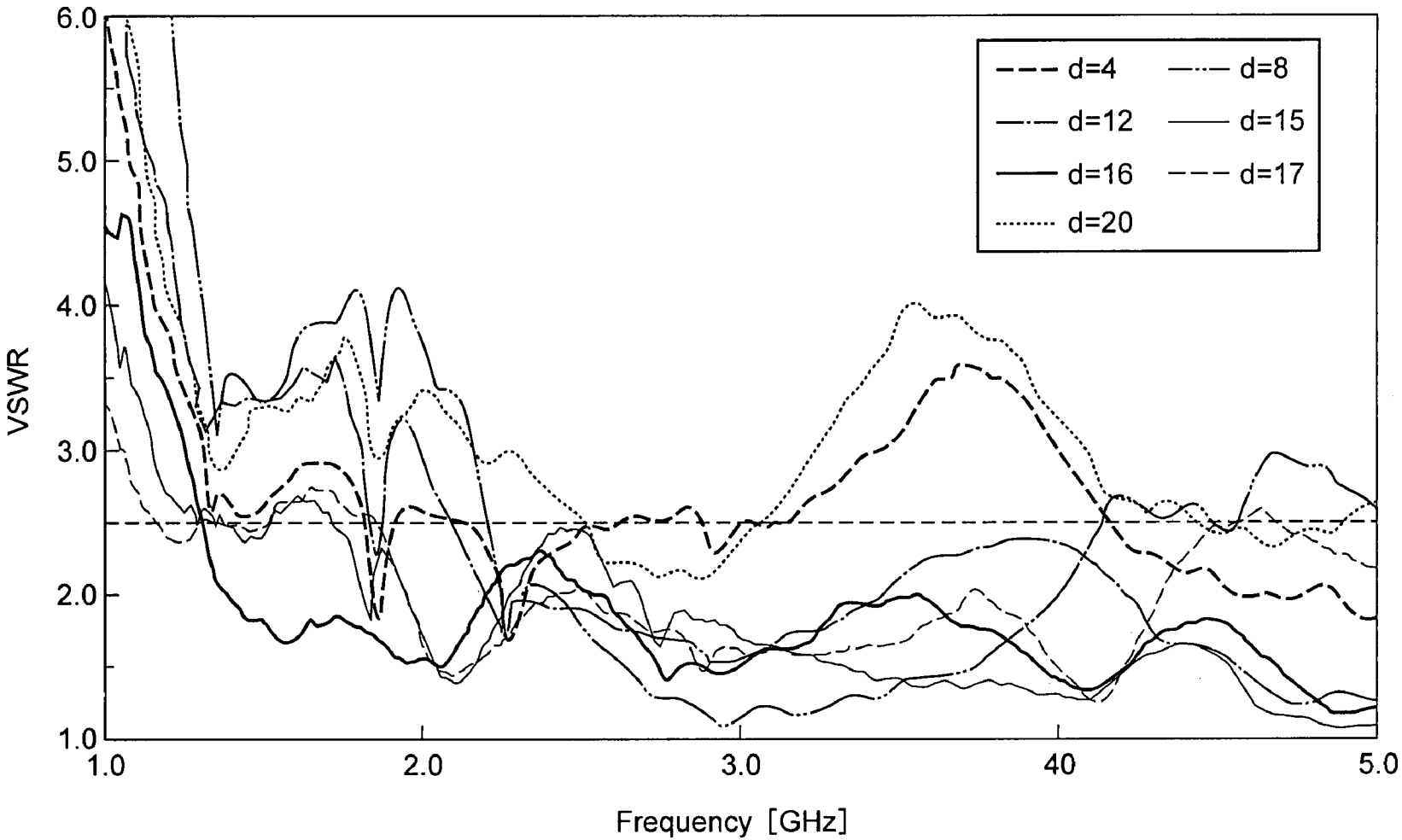
FIG. 5 is a view showing frequency characteristics of VSWRs of the ultra wideband antenna unit illustrated in FIG. 4 when a feeding position d is changed to 4 mm, 8 mm, 12 mm, 15 mm, 16 mm, 17 mm, and 20 mm.
Figure 6:
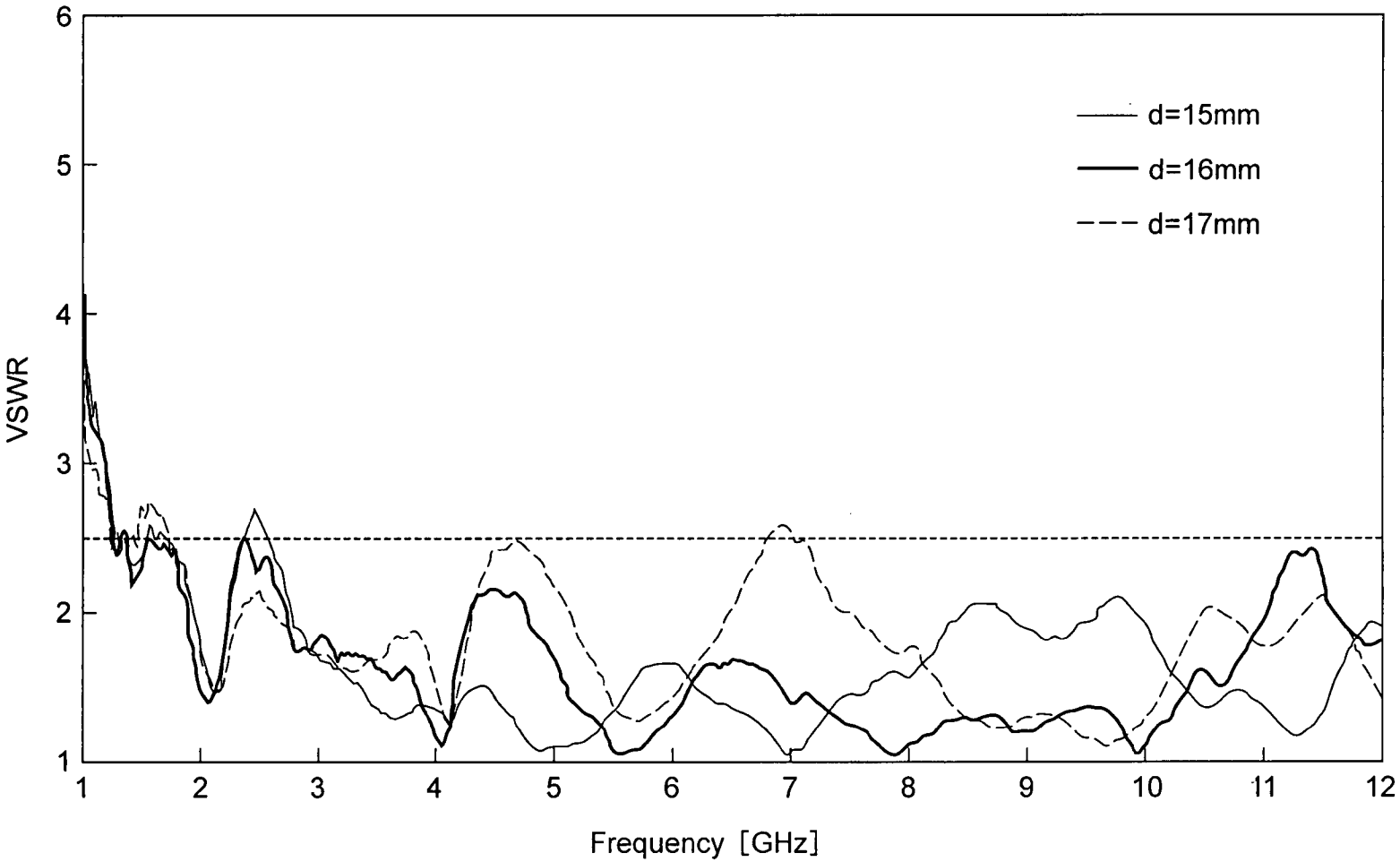
FIG. 6 is a view showing the frequency characteristics of the VSWRs of the ultra wideband antenna unit illustrated in FIG. 4 when the feeding position d is changed to 15 mm, 16 mm, and 17 mm.

FIGS. 5 and 6 show frequency characteristics of VSWRs of the ultra wideband antenna unit 10B when the feeding position (the predetermined distance) d is changed. In FIGS. 5 and 6, the abscissa represents a frequency [GHz] and the ordinate represents the VSWR. FIG. 5 shows the frequency characteristics of the VSWRs when the feeding position d is equal to 4 mm, 8 mm, 12 mm, 15 mm, 16 mm, 17 mm, and 20 mm, respectively. FIG. 6 shows the frequency characteristics of the VSWRs when the feeding position d is equal to 15 mm, 16 mm, and 17 mm, respectively.

As apparent from FIG. 5, it is understood that there are cases where the VSWR is over 2.5 in a frequency range which is not less than about 1.4 GHz when the feeding position d is equal to 4 mm, 8 mm, 12 mm, and 20 mm, On the other hand, as apparent from FIGS. 5 and 6, it is understood that the VSWR is substantially kept within 2.5 or less in the frequency range which is not less than about 1.4 GHz when the feeding position d is equal to 15 mm, 16 mm, and 17 mm. Specifically, it is understood that the VSWR is not more than 2.5 in the frequency range which is not less than about 1.4 GHz when the feeding position d is equal to 16 mm.

As apparent from the foregoing description, it is understood that the frequency characteristic having good VSWR is obtained if a ratio between the width $L_{GX}$ of the ground plate 12 and the feeding position (the predetermined distance) d is substantially 5:2 when a ratio between the width $L_{GX}$ of the ground plate 12 and a width $L_{AX}$ of the first and the second conductive plates 141 and 142 in the antenna element 14B is 2:1.

Figure 7:
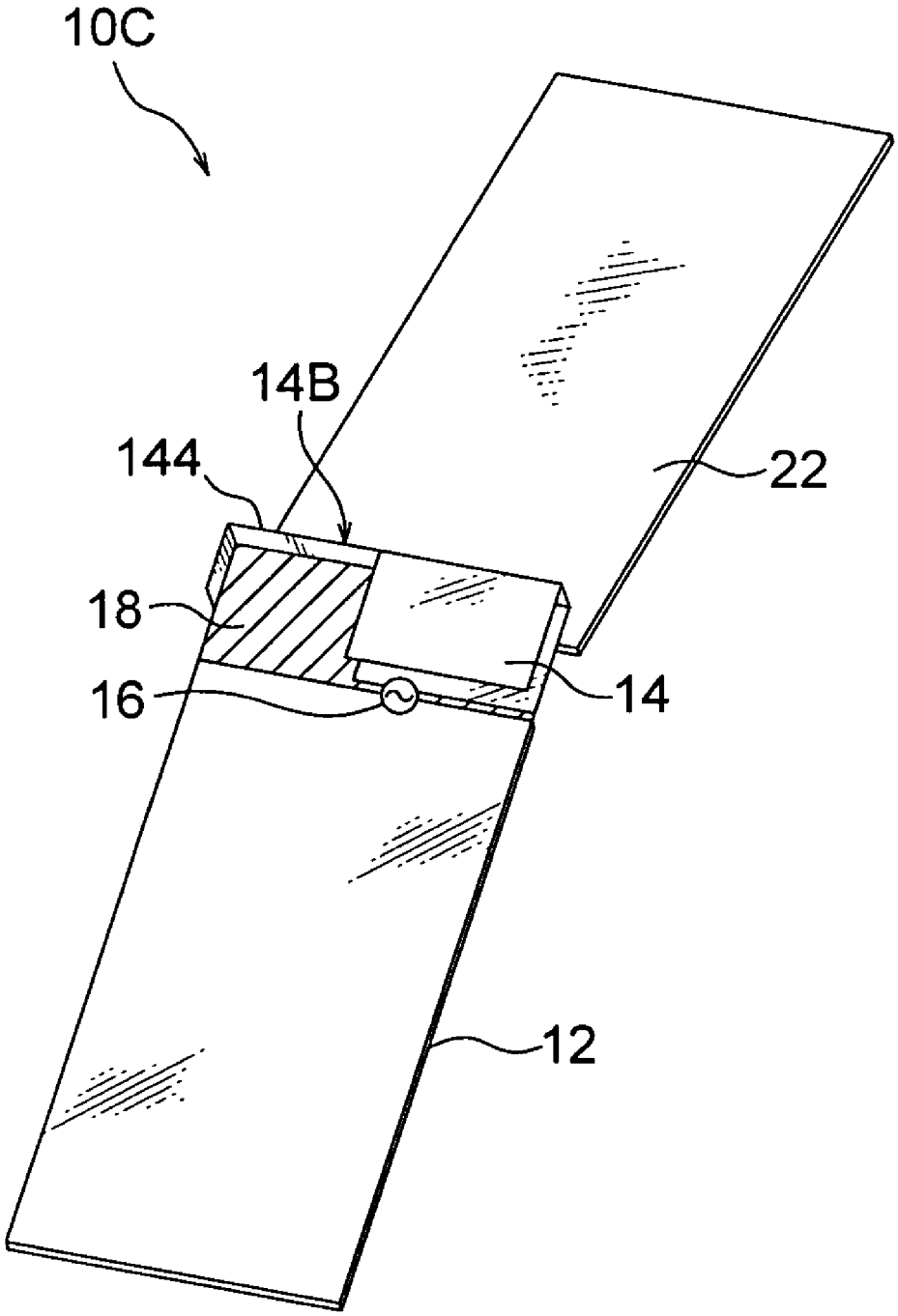
FIG. 7 is a schematic perspective view showing an ultra wideband antenna unit according to a second exemplary embodiment of this invention.

Referring to FIG. 7, the description will proceed to an ultra wideband antenna unit 10C according to a second exemplary embodiment of this invention. The illustrated ultra wideband antenna unit 10C is an antenna unit which can be included in the foldable type mobile telephone set.

The illustrated ultra wideband antenna unit 10C is similar in structure to the ultra wideband antenna unit 10B illustrated in FIG. 4 except that the ultra wideband antenna unit 10C further comprises another ground plate 22. Accordingly, similar reference symbols are attached to those having functions similar to those illustrated in FIG. 4. Herein, the ground plate 12 is called a first ground plate while the other ground plate 22 is called a second ground plate.

The illustrated antenna element 14B is disposed on the hinge portion (not shown) of the foldable type mobile telephone set. Accordingly, as shown in FIG. 7, the antenna element 14B is disposed between the first ground plate 12 and the second ground plate 22 in a state where the foldable type mobile telephone set is opened. In addition, in the example being illustrated, the feeding position d of the feeding point 16 is equal to 16 mm.

Figure 8:
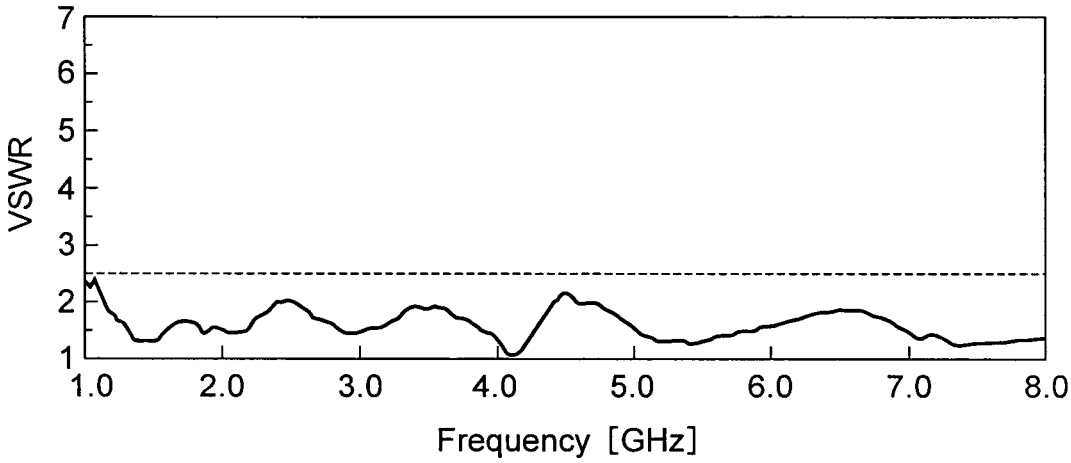
FIG. 8 is a view showing a frequency characteristic of VSWR of the ultra wideband antenna unit illustrated in FIG. 7.

FIG. 8 shows a frequency characteristic of a VSWR of the ultra wideband antenna unit 10C. In FIG. 8, the abscissa represents a frequency [GHz] and the ordinate represents the VSWR.

As apparent from FIG. 8, it is understood that the VSWR is 2.5 or less in a frequency range between 1.0 GHz and 8.0

GHz. Accordingly, it is understood that the ultra wideband antenna unit 10C illustrated in FIG. 7 has a very wideband.

While this invention has thus far been described in conjunction with a few exemplary embodiments thereof, as a matter of course, this invention is not restricted to the above-mentioned exemplary embodiments.

Figure 9:
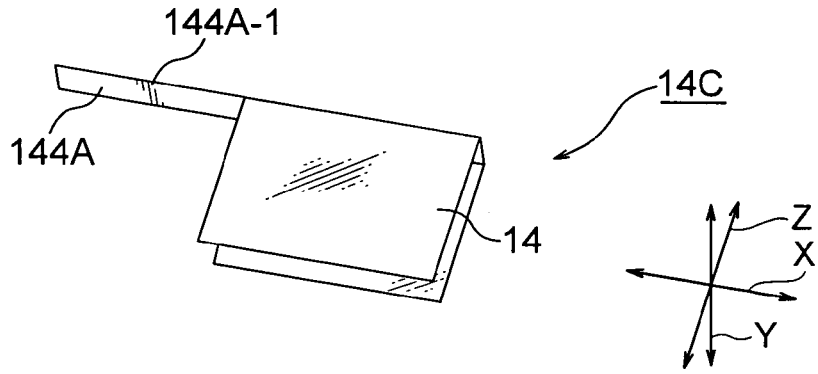
FIG. 9 is a perspective view showing a first modification of the antenna element for use in the ultra wideband antenna unit according to the first exemplary embodiment of this invention.
Figure 10:
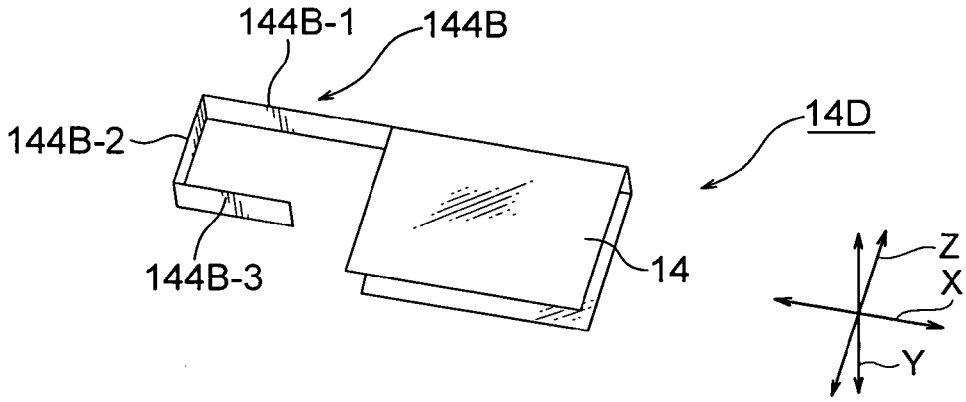
FIG. 10 is a perspective view showing a second modification of the antenna element for use in the ultra wideband antenna unit according to the first exemplary embodiment of this invention.
Figure 11:
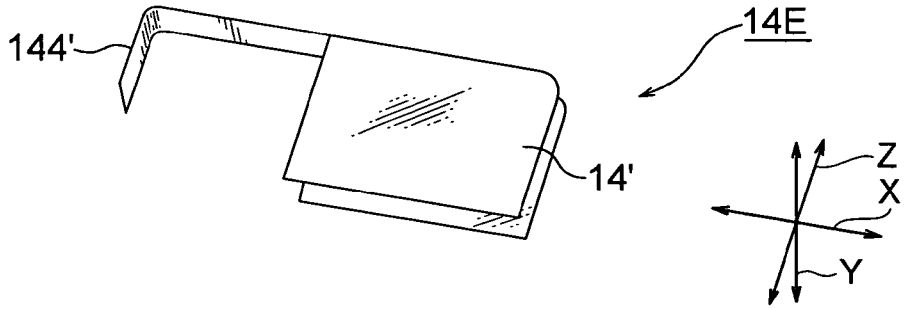
FIG. 11 is a perspective view showing a third modification of the antenna element for use in the ultra wideband antenna unit according to the first exemplary embodiment of this invention.
Figure 12:
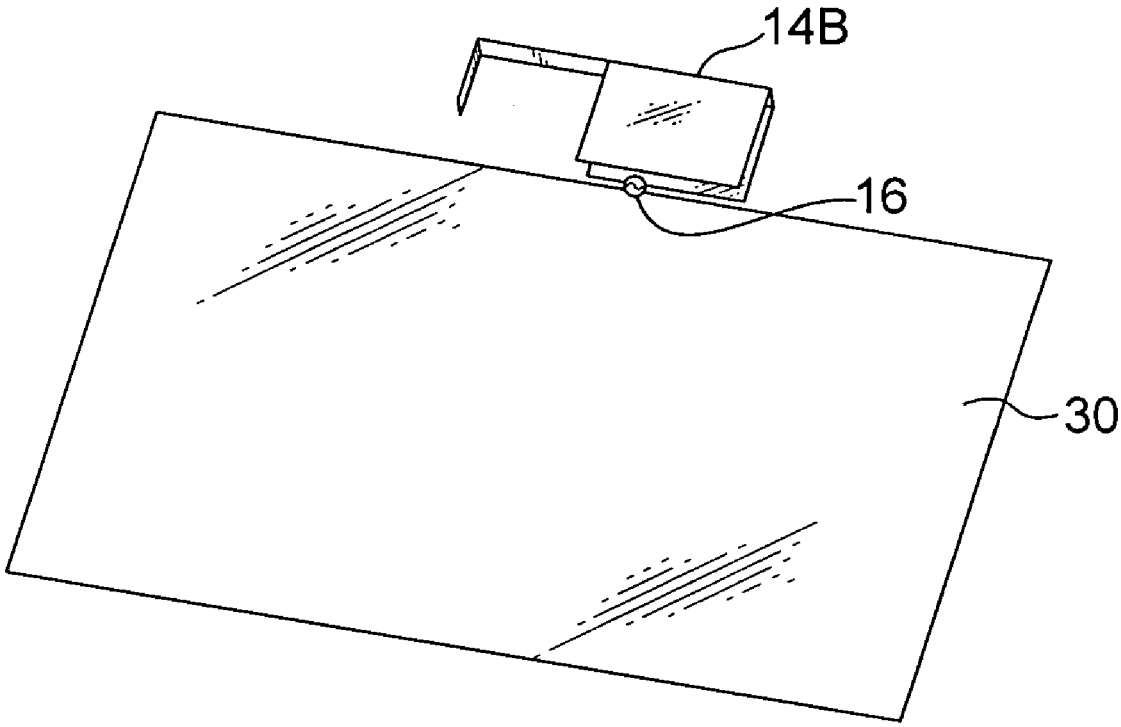
FIG. 12 is a schematic perspective view showing an example where the antenna element for use in the ultra wideband antenna unit according to the first exemplary embodiment of this invention is mounted on a PDA.
Figure 13:
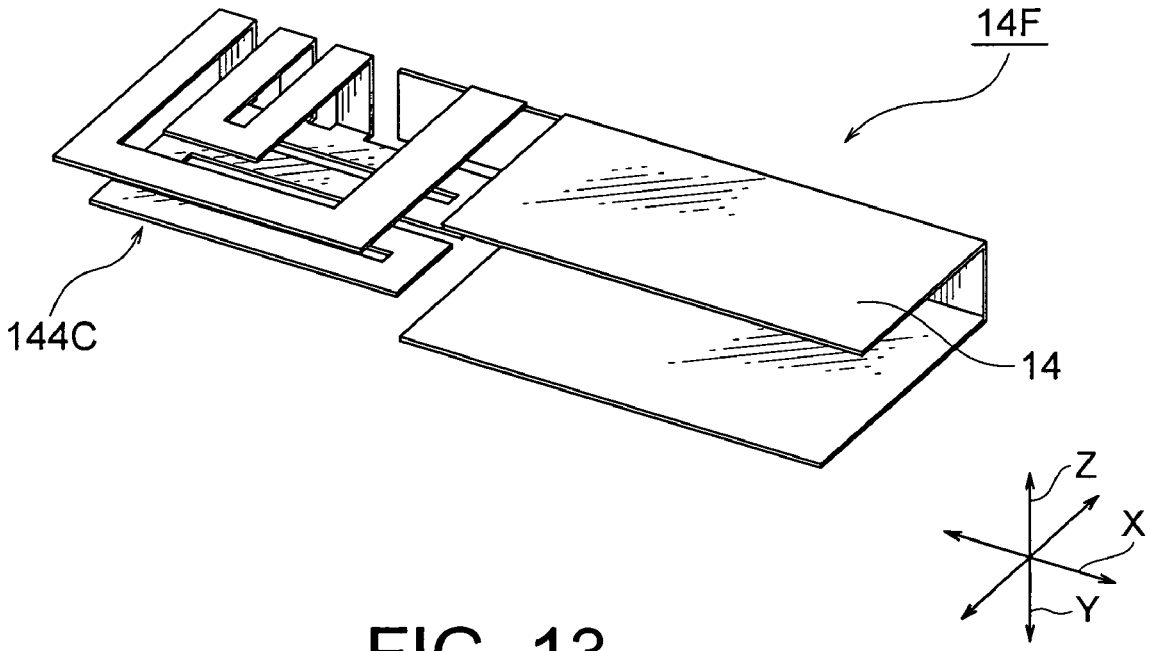
FIG. 13 is a perspective view showing a fourth modification of the antenna element for use in the ultra wideband antenna unit according to the first exemplary embodiment of this invention.

For example, as an antenna element 14C as shown in FIG. 9, an extending portion 144A may not be bent. That is, the extending portion 144A comprises only the first extending portion 144A-1. Alternatively, as an antenna element 14D as shown in FIG. 10, an extending portion 144B may further comprise a third extending portion 144A-3 which is bent at a right angle inward in addition to a first extending portion 144B-1 and a second extending portion 144B-2. Furthermore, as an antenna element 14E shown in FIG. 11, an FPMA 14' and an L-shaped element (an inverted-L element) 144' may have round shape edges. In the manner which will later be described in other exemplary embodiments of this invention, the first and the second conductive plates constituting the FPMA may have different lengths. Alternatively, as shown in FIG. 12, the antenna element 14B may be mounted on a personal digital assistant (PDA) 30. In addition, as an antenna element 14F as shown in FIG. 13, an extending portion 144C may have a meandering shape.

Figure 14:
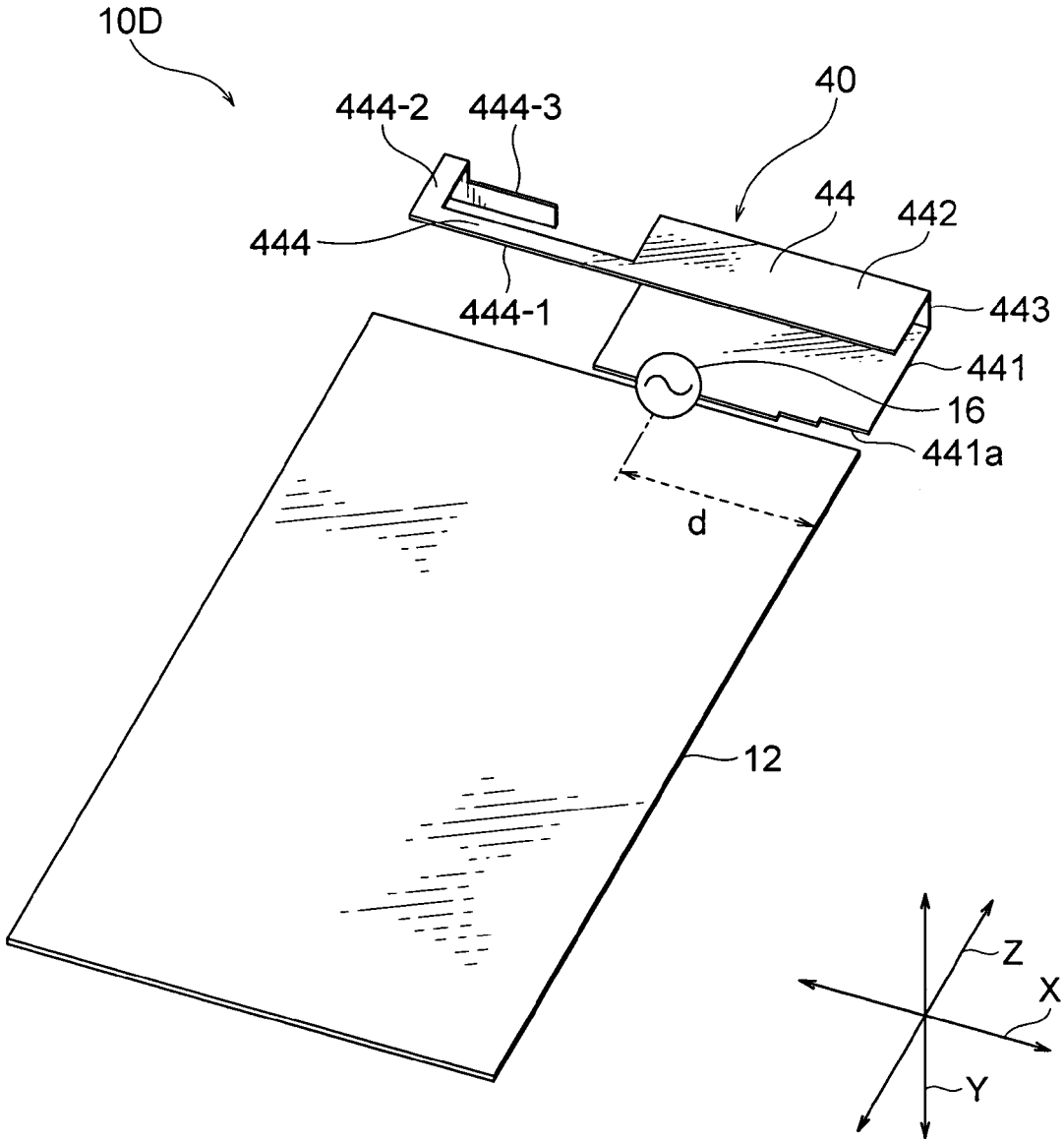
FIG. 14 is a schematic perspective view showing an ultra wideband antenna unit according to a third exemplary embodiment of this invention.
Figure 15:
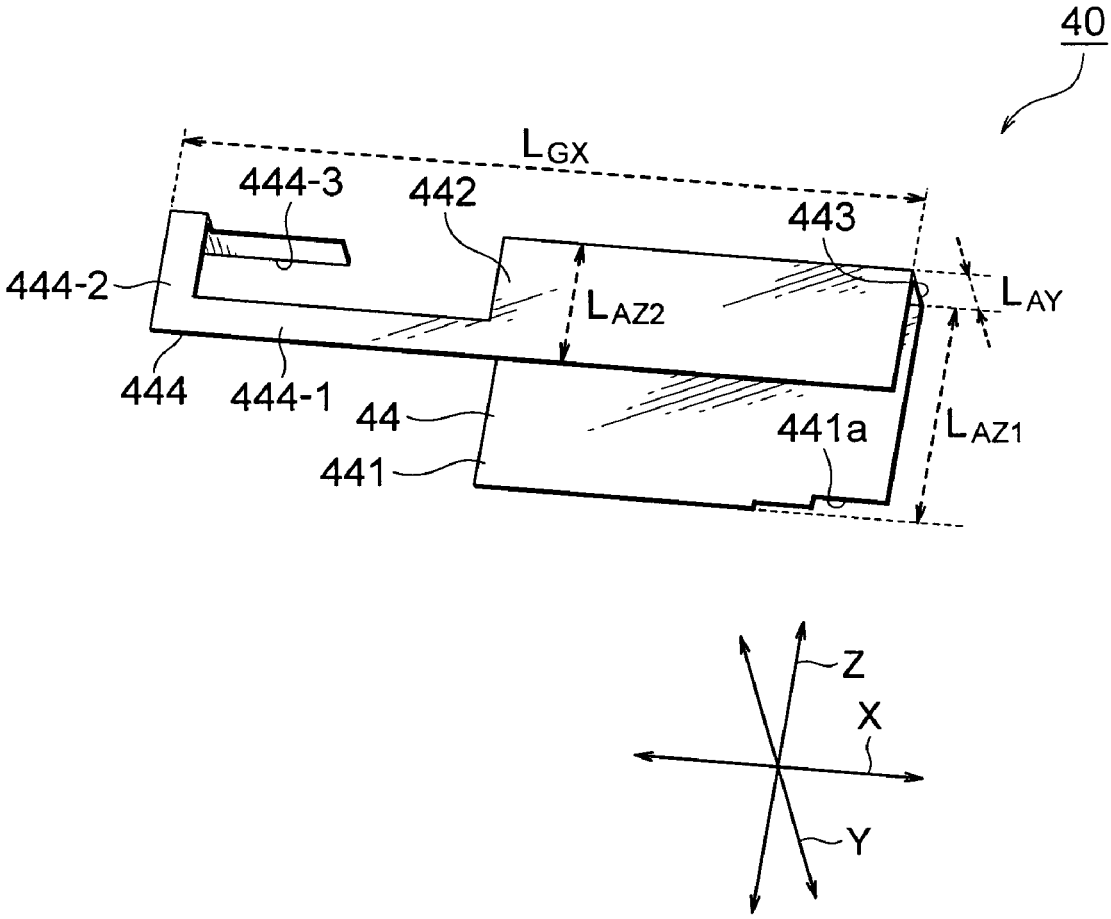
FIG. 15 is an expanded perspective view showing an antenna element for use in the ultra wideband antenna unit illustrated in FIG. 14.

Referring to FIGS. 14 and 15, the description will proceed to an ultra wideband antenna unit 10D according to a third exemplary embodiment of this invention. The illustrated ultra wideband antenna unit 10D is similar in structure to the ultra wideband antenna unit 10B illustrated in FIG. 4 except those points which will later become clear. The antenna element is therefore depicted at 40. Similar reference symbols are attached to those having functions similar to those illustrated in FIG. 4 and the description thereof is omitted for the sake of simplification of the description. FIG. 14 is a schematic perspective view of the ultra wideband antenna unit 10D. FIG. 15 is an expanded perspective view showing only the antenna element 40.

Although illustration is not made in FIG. 14, the antenna element 40 is mounted on the dielectric substrate 18 (see FIG. 4) in the manner as shown in FIG. 4.

The illustrated antenna element 40 comprises a folded plate-shaped monopole antenna portion 44 having a U-shape in cross section and a conductive element 444 connected to the folded plate-shaped monopole antenna portion 44. The conductive element 444 is also called an extending potion because it extends from the folded plate-shaped monopole antenna portion 44 in leftward X. In addition, the folded plate-shaped monopole antenna portion 44 is also called a plate-shaped antenna.

The illustrated folded plate-shaped monopole antenna portion 44 comprises a first conductive plate 441 having a first length $L_{AZ1}$, a second conductive plate 442 disposed in parallel with the first conductive plate 441, and a coupling plate 443 for coupling the first conductive plate 441 with the second conductive plate 442 at a first end portion (an end side) away from the ground plate 12. As shown in FIG. 15, the second conductive plate 442 has a second length $L_{AZ2}$ which is shorter than the first length $L_{AZ1}$. In the example being illustrated, the first length $L_{AZ1}$ is equal to 13 mm.

In the example being illustrated, the first conductive plate 441 has a notch 441*a* at a right side of a tip portion thereof (an end portion opposite to the ground plate 12). In this exemplary embodiment, a right side of the folded plate-shaped monopole antenna portion 44 is called a first side edge while a left side thereof is called a second side edge. Accordingly, the notch 441*a* is formed at the tip portion of the first conductive plate 441 in the first side edge side.

The reason that the notch 441*a* is formed in the first conductive plate 441 is for improving a frequency characteristic of the folded plate-shaped monopole antenna portion 44 by itself.

The conductive element (the extending portion) 444 may extend from any one of the first conducive plate 441, the second conductive plate 442, and the coupling plate 443. In the example being illustrated, the extending portion 444 comprises a first extending portion 444-1, a second extending portion 444-2, and a third extending portion 444-3. The first extending portion 444-1 extends from the second side edge (the left side) of a tip portion of the second conductive plate 442 on an extending plane where the second extending portion 442 extends in a longitudinal direction (leftward) X of the second conductive plate 442. The second extending portion 444-2 is bent from a tip of the first extending portion 444-1 in a direction at right angles thereto toward the above-mentioned first end portion (the side away from the ground plate 12) on the extending plane where the second conductive plate 442 extends. The third extending portion 444-3 is bent from a tip of the second extending portion 444-2 in a direction at right angles thereto and extends nearer to the coupling plate 443 on an extending plane where the coupling plate 443 extends.

Herein, a length between the feeding point 16 and a tip of the conductive element (the extending portion) 44 is equal to about a quarter of the wavelength in an operating minimum frequency. That is, the folded plate-shaped monopole antenna portion 44 is provided with the conductive element (the extending portion) 444 which is operable at a frequency range (of 2.5 GHz or less in a case of this exemplary embodiment) which cannot be covered by the folded plate-shaped monopole antenna portion 44. In this event, the conductive element (the extending portion) 444 has a length which is equal to about 0.25 wavelength at a frequency of 1.5 GHz.

Figure 16:
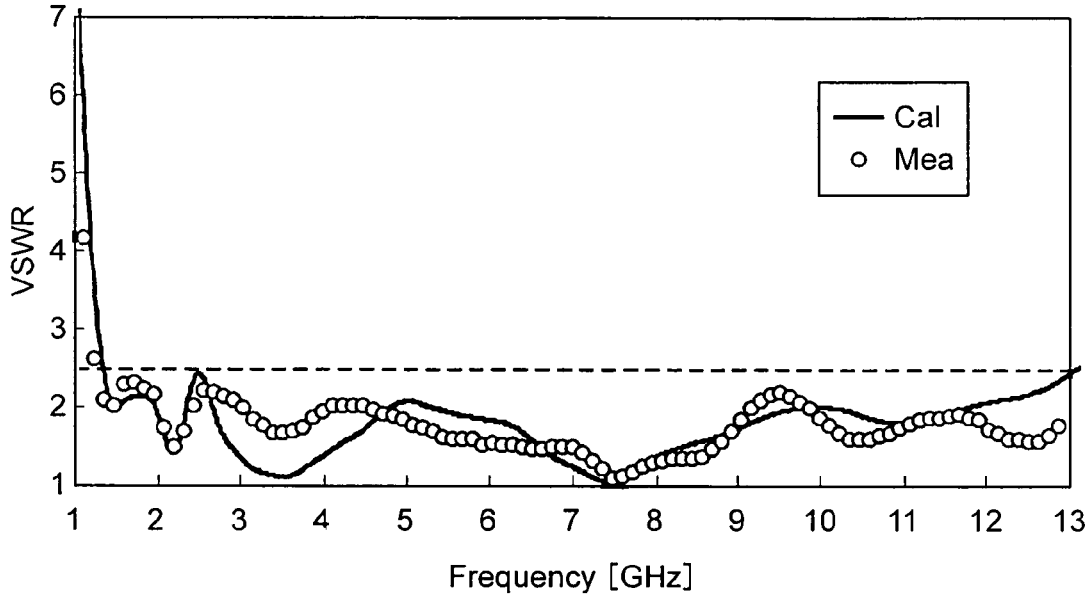
FIG. 16 is a view showing frequency characteristics of VSWRs of the ultra wideband antenna unit illustrated in FIG. 14.

FIG. 16 shows a frequency characteristic of a VSWR of the ultra wideband antenna unit 10D illustrated in FIG. 14. In FIG. 16, the abscissa represents a frequency [GHz] and the ordinate represents the VSWR. In FIG. 16, Cal represents a VSWR value which is obtained by calculating and Mea represents a VSWR value which is obtained by actual measurement.

As apparent from FIG. 16, it is understood that the VSWR is 2.5 or less in a frequency range between 1.35 GHz and 13.0 GHz. Accordingly, it is understood that the ultra wideband antenna unit 10D illustrated in FIG. 14 has a very wideband. At any rate, the ultra wideband antenna unit 10D realizes a broadband due to its shape so that the conductive element (the extending portion) 44 operates the frequency range where a normal plate-shaped antenna (the folded plate-shaped monopole antenna (FPMA) illustrated in FIG. 1) cannot operate.

In the manner which is described above, the conductive element (the extending portion) may be disposed at any position of the plate-shaped antenna and may not be bent. Now, the description will be made as regards modifications of the antenna element and VSWR characteristics thereof. In addition, each of the modifications of the antenna element which will later be described has the folded plate-shaped monopole antenna portion (the plate-shaped antenna) 44 which is similar in structure to that illustrated in FIG. 15 but has the conductive element (the extending portion) having a mounted position and a shape which are different from those illustrated in FIG. 15.

Figure 17:
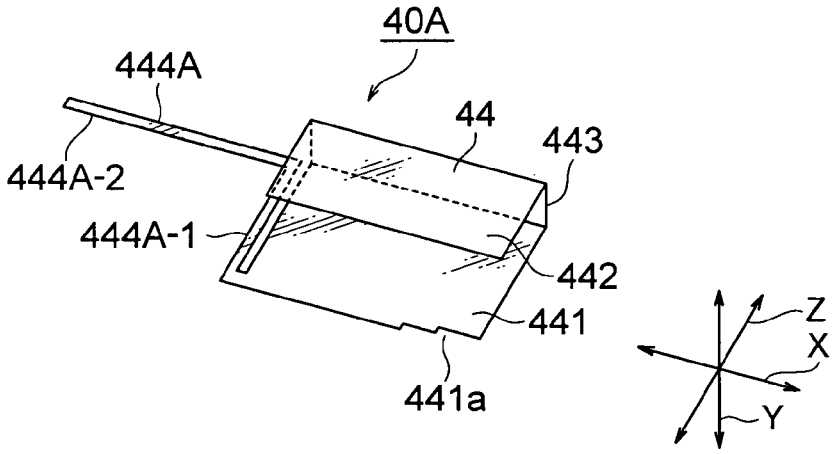
FIG. 17 is a perspective view showing a first modification of the antenna element for use in the ultra wideband antenna unit according to the third exemplary embodiment of this invention.

FIG. 17 is a perspective view showing a first modification 40A of the antenna element. The illustrated antenna element 40A is an example where a conductive element (an extending portion) 444A is disposed in the plate-shaped antenna 44 at a left and back portion thereof. That is, the conductive element (the extending portion) 444A comprises a first extending portion 444A-1 and a second extending portion 444A-2. More specifically, the first extending portion 444A-1 extends from the second side edge (the left side) of a tip portion of the first conductive plate 441 on an extending plane where the first conductive plate 441 extends in parallel with the second side edge of the first conductive plate 441 and apart from the second side edge by a predetermined distance. The second extending portion 444A-2 extends from a tip of the first extending portion 444A-1 in the vicinity of the above-mentioned first end portion of the coupling plate 443 in a direction at right angles thereto and extends away from the coupling plate 443 on an extending plane where the first conductive plate 441 extends.

Figure 18:
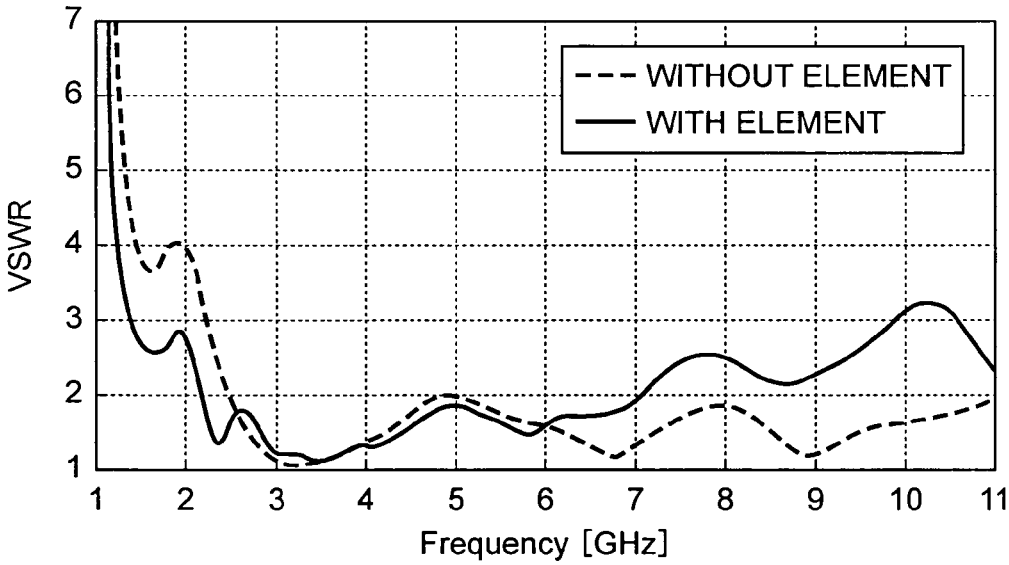
FIG. 18 is a view showing a frequency characteristic of VSWR of the ultra wideband antenna unit comprising the antenna element illustrated in FIG. 17.

FIG. 18 shows a frequency characteristic of a VSWR of the ultra wideband antenna unit comprising the antenna element 40A illustrated in FIG. 17. In FIG. 18, the abscissa represents a frequency [GHz] and the ordinate represents the VSWR. In FIG. 18, a solid line shows a VSWR characteristic in a case where there is the conductive element (the extending portion) 444A and a broken line shows a VSWR characteristic in a case where there is no the conductive element (the extending portion) 444A. As apparent from FIG. 18, in comparison with the case where there is no the conductive element (the extending portion) 444A, it is understood that the VSWR characteristic is excellent in a frequency range of about 2.5 GHz or less in the case where there is the conductive element (the extending portion) 444A.

Figure 19:
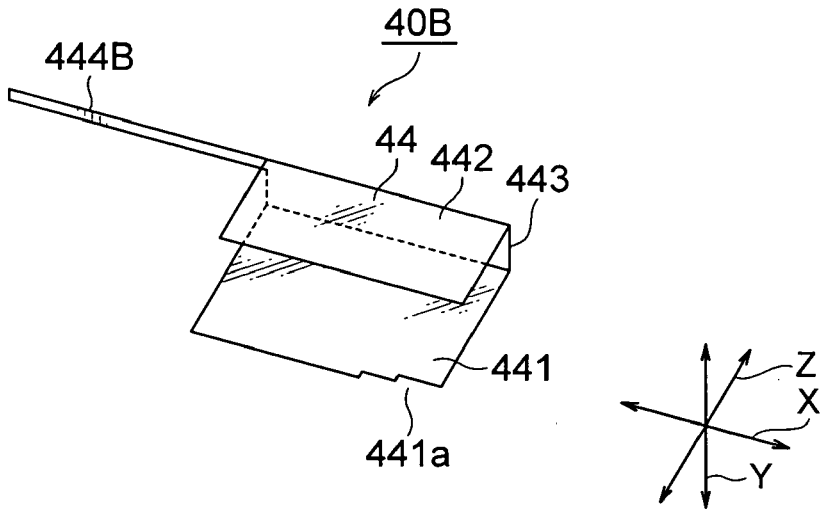
FIG. 19 is a perspective view showing a second modification of the antenna element for use in the ultra wideband antenna unit according to the third exemplary embodiment of this invention.

FIG. 19 is a perspective view showing a second modification 40B of the antenna element. The illustrated antenna element 40B is an example where a conductive element (an extending portion) 444B is disposed in the plate-shaped antenna 44 at a left and upper portion thereof. That is, the conductive element (the extending portion) 444B extends from the second side edge (the left side) of the coupling plate 443 on an extending plane where the coupling plate 443 extends in a longitudinal direction (leftward) X of the coupling plate 443.

Figure 20:
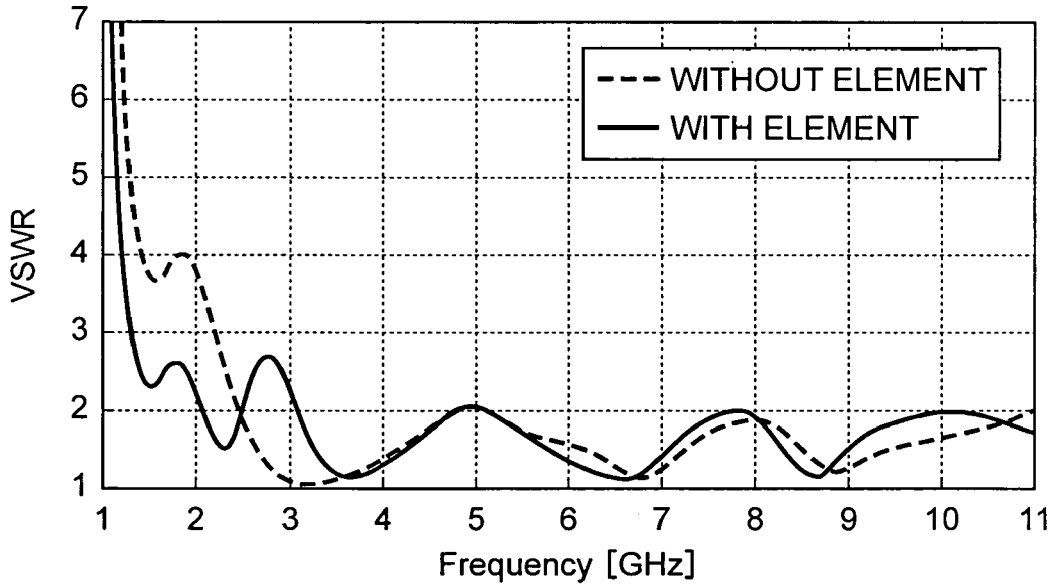
FIG. 20 is a view showing a frequency characteristic of VSWR of the ultra wideband antenna unit comprising the antenna element illustrated in FIG. 19.

FIG. 20 shows a frequency characteristic of a VSWR of the ultra wideband antenna unit comprising the antenna element 40B illustrated in FIG. 19. In FIG. 20, the abscissa represents a frequency [GHz] and the ordinate represents the VSWR. In FIG. 20, a solid line shows a VSWR characteristic in a case where there is the conductive element (the extending portion) 444B and a broken line shows a VSWR characteristic in a case where there is no the conductive element (the extending portion) 444B. As apparent from FIG. 20, in comparison with the case where there is no the conductive element (the extending portion) 444B, it is understood that the VSWR characteristic is excellent in a frequency range of about 2.5 GHz or less in the case where there is the conductive element (the extending portion) 444B.

Figure 21:
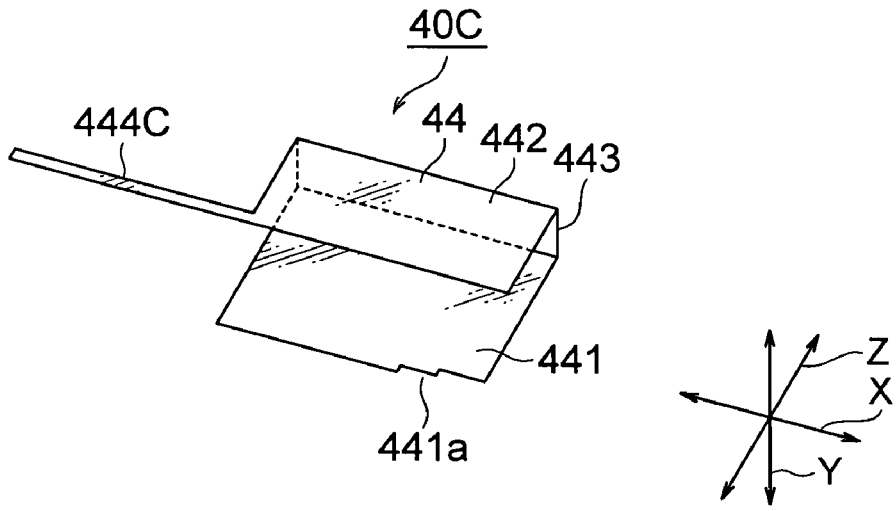
FIG. 21 is a perspective view showing a third modification of the antenna element for use in the ultra wideband antenna unit according to the third exemplary embodiment of this invention.

FIG. 21 is a perspective view showing a third modification 40C of the antenna element. The illustrated antenna element 40C is an example where a conductive element (an extending portion) 444C is disposed in the plate-shaped antenna 44 at a left and front portion thereof. That is, the conductive element (the extending portion) 444C extends from the second side edge (the left side) of the tip portion of the second conductive plate 442 on an extending plane where the second conductive plate 442 extends in a longitudinal direction (leftward) X of the second conductive plate 442.

Figure 22:
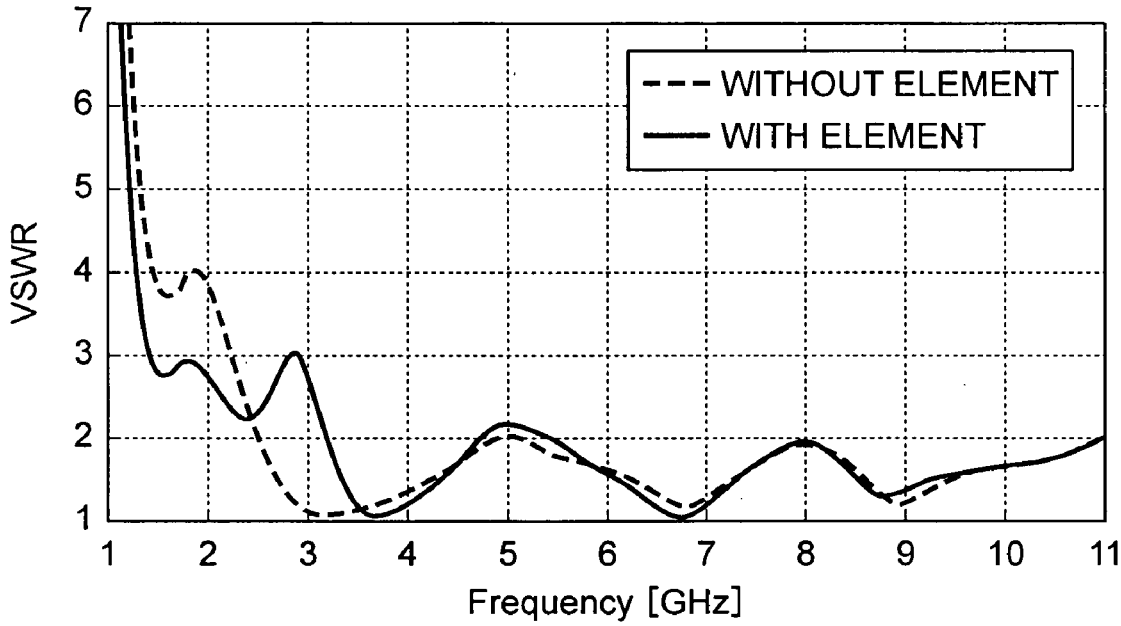
FIG. 22 is a view showing a frequency characteristic of VSWR of the ultra wideband antenna unit comprising the antenna element illustrated in FIG. 21.

FIG. 22 shows a frequency characteristic of a VSWR of the ultra wideband antenna unit comprising the antenna element 40C illustrated in FIG. 21. In FIG. 22, the abscissa represents a frequency [GHz] and the ordinate represents the VSWR. In FIG. 22, a solid line shows a VSWR characteristic in a case where there is the conductive element (the extending portion) 444C and a broken line shows a VSWR characteristic in a case where there is no the conductive element (the extending portion) 444C. As apparent from FIG. 22, in comparison with the case where there is no the conductive element (the extending portion) 444C, it is understood that the VSWR characteristic is excellent in a frequency range of about 2.5 GHz or less in the case where there is the conductive element (the extending portion) 444C.

Figure 23:
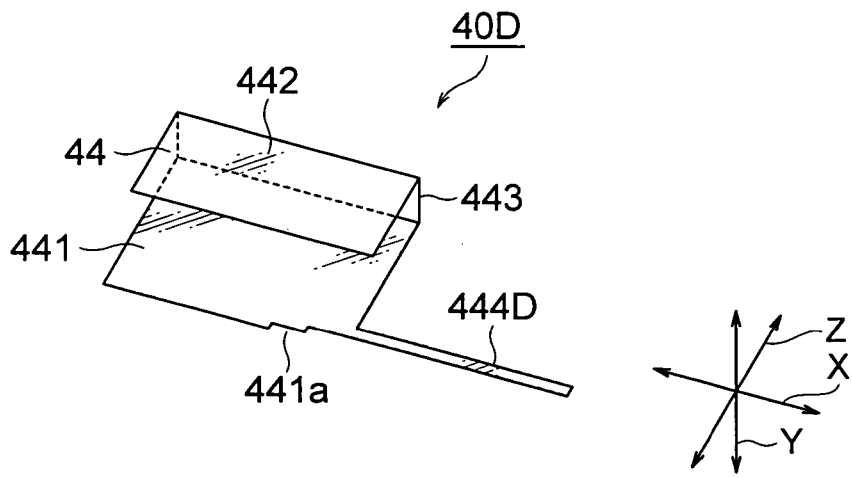
FIG. 23 is a perspective view showing a fourth modification of the antenna element for use in the ultra wideband antenna unit according to the third exemplary embodiment of this invention.

FIG. 23 is a perspective view showing a fourth modification 40D of the antenna element. The illustrated antenna element 40D is an example where a conductive element (an extending portion) 444D is disposed in the plate-shaped antenna 44 at a right and back portion thereof. That is, the conductive element (the extending portion) 444D extends from the first side edge (the left side) of the tip portion of the first conductive plate 441 on an extending plane where the first conductive plate 441 extends in a longitudinal direction (rightward) X of the first conductive plate 441.

Figure 24:
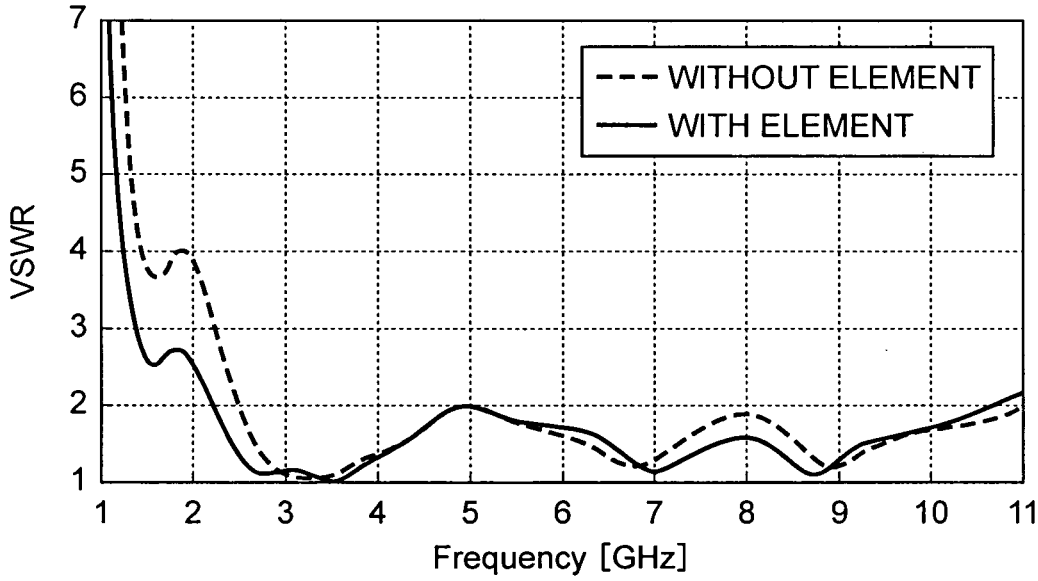
FIG. 24 is a view showing a frequency characteristic of VSWR of the ultra wideband antenna unit comprising the antenna element illustrated in FIG. 23.

FIG. 24 shows a frequency characteristic of a VSWR of the ultra wideband antenna unit comprising the antenna element 40D illustrated in FIG. 23. In FIG. 24, the abscissa represents a frequency [GHz] and the ordinate represents the VSWR. In FIG. 24, a solid line shows a VSWR characteristic in a case where there is the conductive element (the extending portion) 444D and a broken line shows a VSWR characteristic in a case where there is no the conductive element (the extending portion) 444D. As apparent from FIG. 24, in comparison with the case where there is no the conductive element (the extending portion) 444D, it is understood that the VSWR characteristic is excellent in a frequency range of about 2.9 GHz or less in the case where there is the conductive element (the extending portion) 444D.

Figure 25:
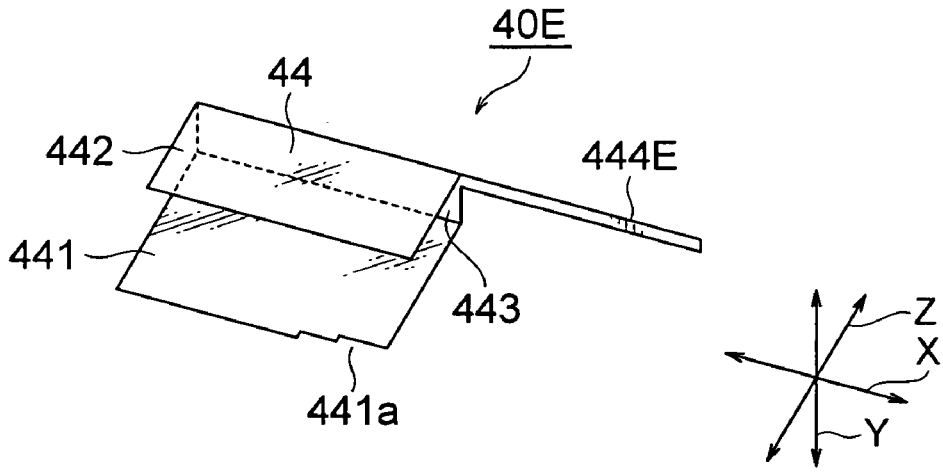
FIG. 25 is a perspective view showing a fifth modification of the antenna element for use in the ultra wideband antenna unit according to the third exemplary embodiment of this invention.

FIG. 25 is a perspective view showing a fifth modification 40E of the antenna element. The illustrated antenna element 40E is an example where a conductive element (an extending portion) 444E is disposed in the plate-shaped antenna 44 at a right and upper portion thereof. That is, the conductive element (the extending portion) 444E extends from the first side edge (the left side) of the coupling plate 443 on an extending plane where the coupling plate 443 extends in a longitudinal direction (rightward) X of the coupling plate 443.

Figure 26:
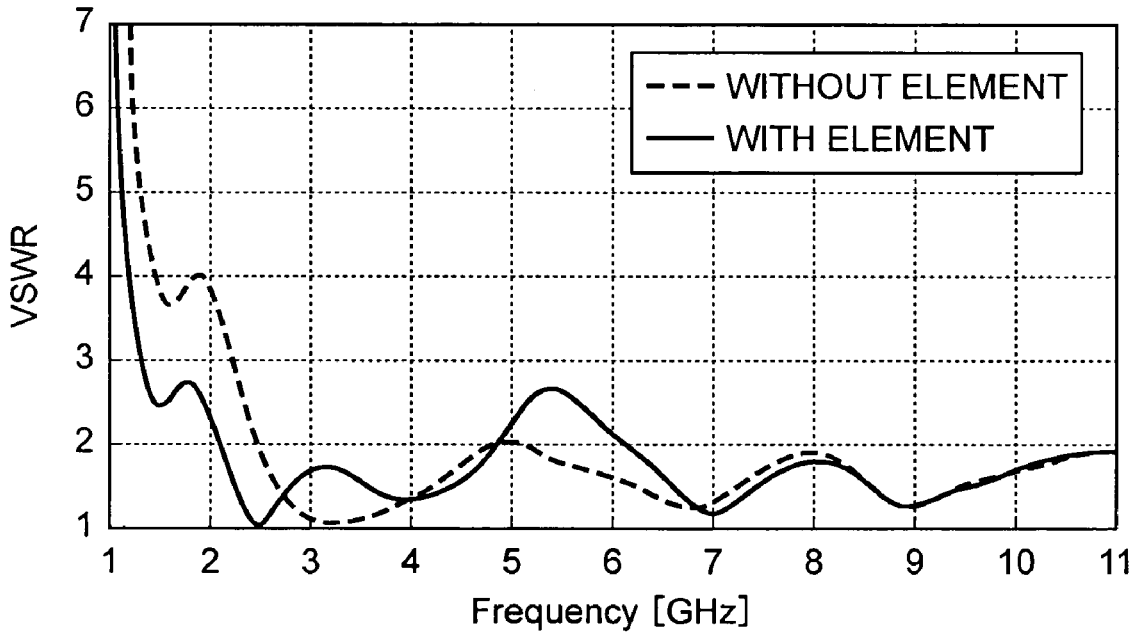
FIG. 26 is a view showing a frequency characteristic of VSWR of the ultra wideband antenna unit comprising the antenna element illustrated in FIG. 25.

FIG. 26 shows a frequency characteristic of a VSWR of the ultra wideband antenna unit comprising the antenna element 40E illustrated in FIG. 25. In FIG. 26, the abscissa represents a frequency [GHz] and the ordinate represents the VSWR. In FIG. 26, a solid line shows a VSWR characteristic in a case where there is the conductive element (the extending portion) 444E and a broken line shows a VSWR characteristic in a case where there is no the conductive element (the extending portion) 444E. As apparent from FIG. 26, in comparison with the case where there is no the conductive element (the extending portion) 444E, it is understood that the VSWR characteristic is excellent in a frequency range of about 2.7 GHz or less in the case where there is the conductive element (the extending portion) 444E.

Figure 27:
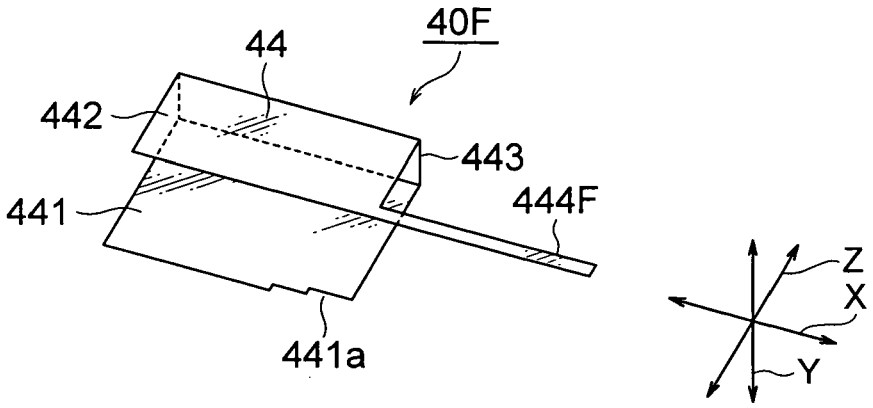
FIG. 27 is a perspective view showing a sixth modification of the antenna element for use in the ultra wideband antenna unit according to the third exemplary embodiment of this invention.

FIG. 27 is a perspective view showing a sixth modification 40F of the antenna element. The illustrated antenna element 40F is an example where a conductive element (an extending portion) 444F is disposed in the plate-shaped antenna 44 at a right and front portion thereof. That is, the conductive element (the extending portion) 444F extends from the first side edge (the right side) of the tip portion of the second conductive plate 442 on an extending plane where the second conductive plate 442 extends in a longitudinal direction (rightward) X of the second conductive plate 442.

Figure 28:
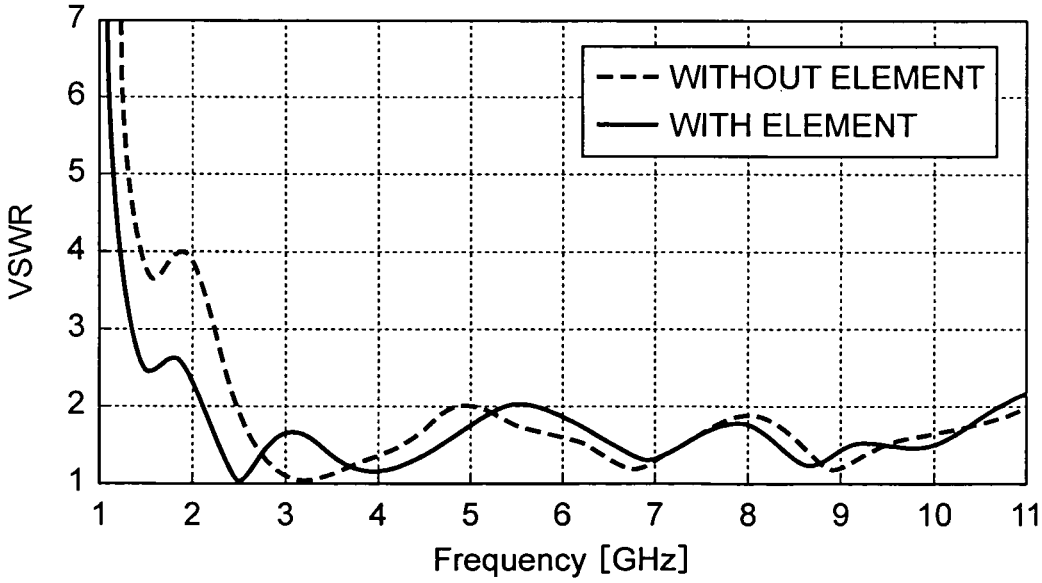
FIG. 28 is a view showing a frequency characteristic of VSWR of the ultra wideband antenna unit comprising the antenna element illustrated in FIG. 27.

FIG. 28 shows a frequency characteristic of a VSWR of the ultra wideband antenna unit comprising the antenna element 40F illustrated in FIG. 27. In FIG. 28, the abscissa represents a frequency [GHz] and the ordinate represents the VSWR. In FIG. 28, a solid line shows a VSWR characteristic in a case where there is the conductive element (the extending portion) 444F and a broken line shows a VSWR characteristic in a case where there is no the conductive element (the extending portion) 444F. As apparent from FIG. 28, in comparison with the case where there is no the conductive element (the extending portion) 444F, it is understood that the VSWR characteristic is excellent in a frequency range of about 2.7 GHz or less in the case where there is the conductive element (the extending portion) 444F.

Figure 29:
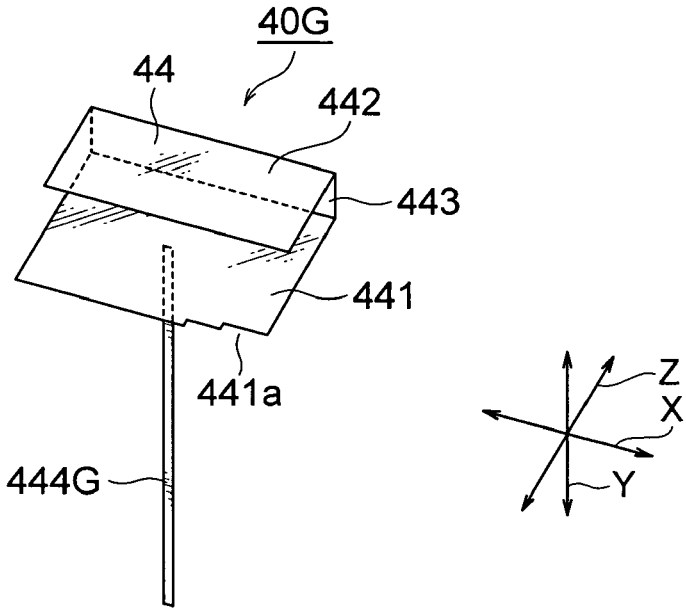
FIG. 29 is a perspective view showing a seventh modification of the antenna element for use in the ultra wideband antenna unit according to the third exemplary embodiment of this invention.

FIG. 29 is a perspective view showing a seventh modification 40G of the antenna element. The illustrated antenna element 40G is an example where a conductive element (an extending portion) 444G is disposed in the plate-shaped antenna 44 at a back surface thereof. That is, the conductive element (the extending portion) 444G extends from the first conductive plate 441 in a direction (backward) Y which intersecting at right angles on an extending plane where the first conductive plate 441 extends.

Figure 30:
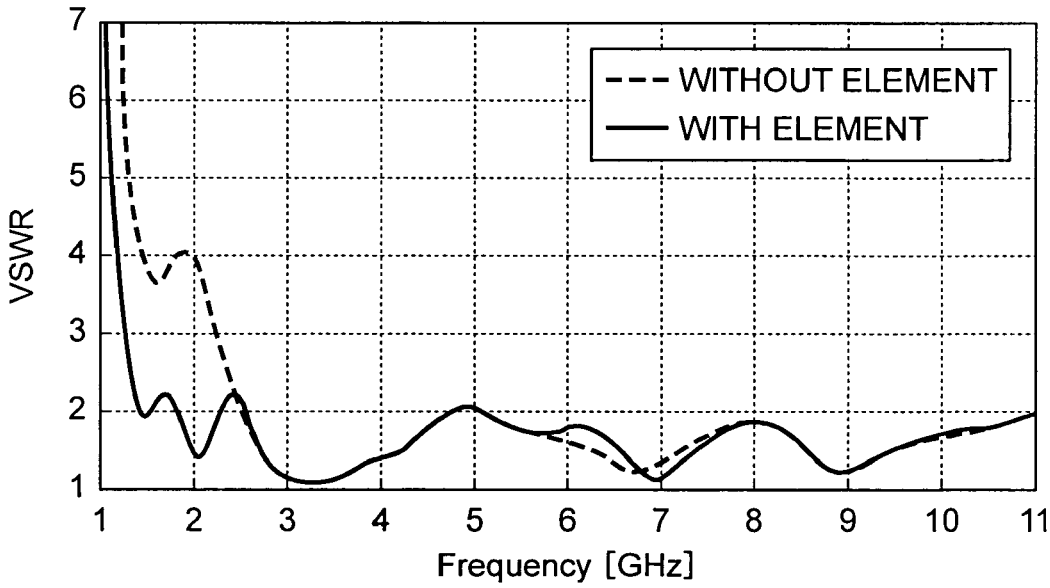
FIG. 30 is a view showing a frequency characteristic of VSWR of the ultra wideband antenna unit comprising the antenna element illustrated in FIG. 29.

FIG. 30 shows a frequency characteristic of a VSWR of the ultra wideband antenna unit comprising the antenna element 40G illustrated in FIG. 29. In FIG. 30, the abscissa represents a frequency [GHz] and the ordinate represents the VSWR. In FIG. 30, a solid line shows a VSWR characteristic in a case where there is the conductive element (the extending portion) 444G and a broken line shows a VSWR characteristic in a case where there is no the conductive element (the extending portion) 444G. As apparent from FIG. 30, in comparison with the case where there is no the conductive element (the extending portion) 444G, it is understood that the VSWR characteristic is excellent in a frequency range of about 2.6 GHz or less in the case where there is the conductive element (the extending portion) 444G.

Figure 31:
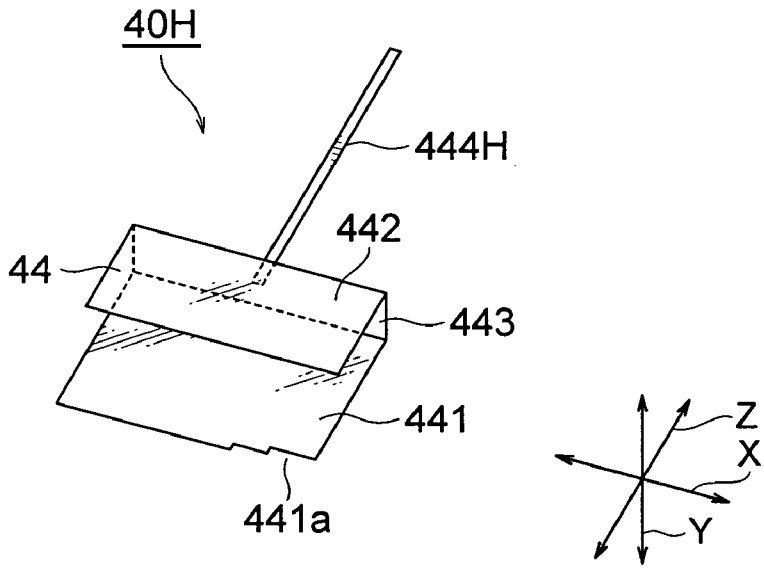
FIG. 31 is a perspective view showing an eighth modification of the antenna element for use in the ultra wideband antenna unit according to the third exemplary embodiment of this invention.

FIG. 31 is a perspective view showing an eighth modification 40H of the antenna element. The illustrated antenna element 40H is an example where a conductive element (an extending portion) 444H is disposed in the plate-shaped antenna 44 at an upper surface thereof. That is, the conductive element (the extending portion) 444H extends from the coupling plate 443 in a direction (upward) Z which intersecting at right angles on an extending plane where the coupling plate 443 extends.

Figure 32:
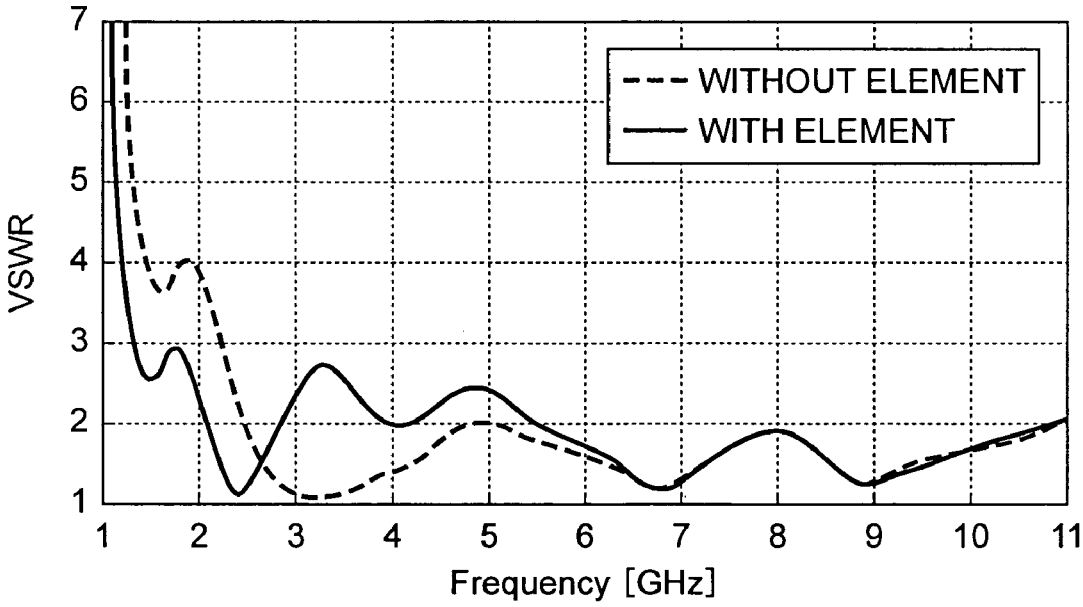
FIG. 32 is a view showing a frequency characteristic of VSWR of the ultra wideband antenna unit comprising the antenna element illustrated in FIG. 31.

FIG. 32 shows a frequency characteristic of a VSWR of the ultra wideband antenna unit comprising the antenna element 40H illustrated in FIG. 31. In FIG. 32, the abscissa represents a frequency [GHz] and the ordinate represents the VSWR. In FIG. 32, a solid line shows a VSWR characteristic in a case where there is the conductive element (the extending portion) 444H and a broken line shows a VSWR characteristic in a case where there is no the conductive element (the extending portion) 444H. As apparent from FIG. 32, in comparison with the case where there is no the conductive element (the extending portion) 444H, it is understood that the VSWR characteristic is excellent in a frequency range of about 2.7 GHz or less in the case where there is the conductive element (the extending portion) 444H.

Figure 33:
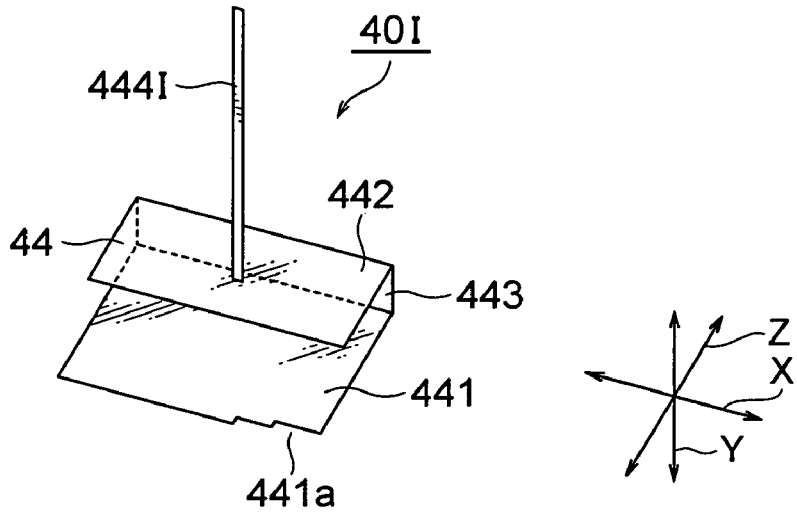
FIG. 33 is a perspective view showing a ninth modification of the antenna element for use in the ultra wideband antenna unit according to the third exemplary embodiment of this invention.

FIG. 33 is a perspective view showing a ninth modification 40I of the antenna element. The illustrated antenna element 40I is an example where a conductive element (an extending portion) 444I is disposed in the plate-shaped antenna 44 at a front surface thereof. That is, the conductive element (the extending portion) 444I extends from the second conductive plate 442 in a direction (forward) Y which intersecting at right angles on an extending plane where the second conductive plate 442 extends.

Figure 34:
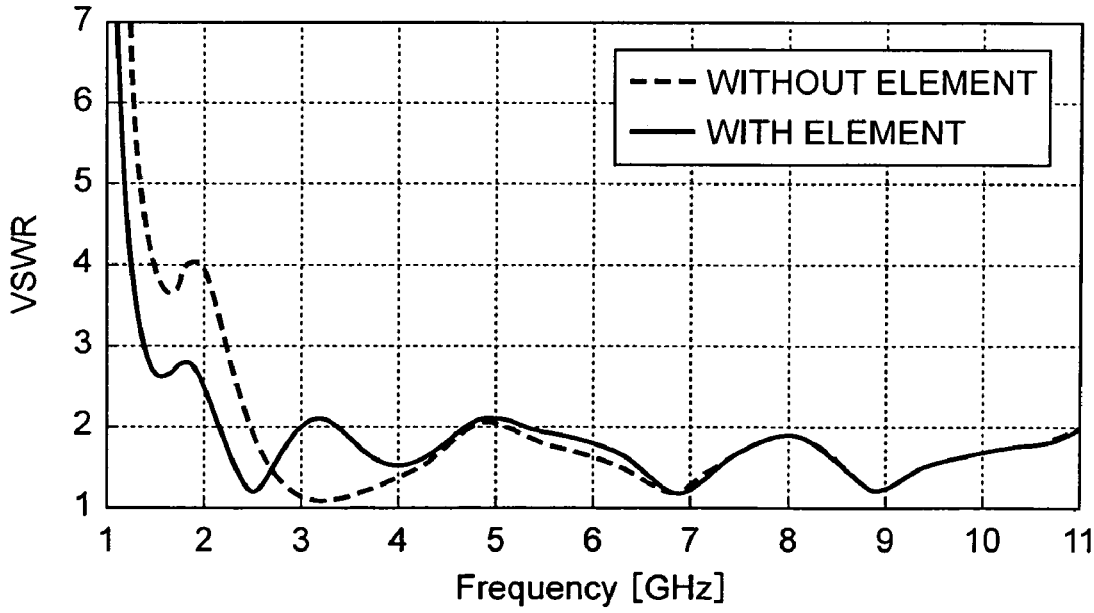
FIG. 34 is a view showing a frequency characteristic of VSWR of the ultra wideband antenna unit comprising the antenna element illustrated in FIG. 33.

FIG. 34 shows a frequency characteristic of a VSWR of the ultra wideband antenna unit comprising the antenna element 40I illustrated in FIG. 33. In FIG. 34, the abscissa represents a frequency [GHz] and the ordinate represents the VSWR. In FIG. 34, a solid line shows a VSWR characteristic in a case where there is the conductive element (the extending portion) 444I and a broken line shows a VSWR characteristic in a case where there is no the conductive element (the extending portion) 444I. As apparent from FIG. 34, in comparison with the case where there is no the conductive element (the extending portion) 444I, it is understood that the VSWR characteristic is excellent in a frequency range of about 2.7 GHz or less in the case where there is the conductive element (the extending portion) 444I.

Figure 35:
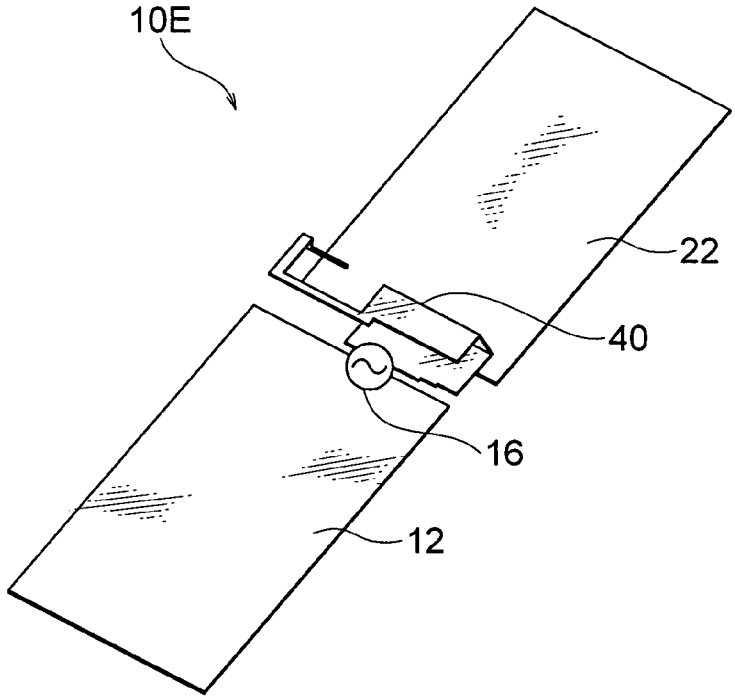
FIG. 35 is a schematic perspective view showing an ultra wideband antenna unit according to a fourth exemplary embodiment of this invention.

Referring to FIG. 35, the description will proceed to an ultra wideband antenna unit 10E according to a fourth exemplary embodiment of this invention. The illustrated ultra wideband antenna unit 10E is an antenna unit which can be included in the foldable type mobile telephone set.

The illustrated ultra wideband antenna unit 10E is similar in structure to the ultra wideband antenna unit 10D illustrated in FIG. 14 except that the ultra wideband antenna unit 10E further comprises another ground plate 22. Accordingly, similar reference symbols are attached to those having functions similar to those illustrated in FIG. 14. Herein, the ground plate 12 is called a first ground plate while the other ground plate 22 is called a second ground plate.

In other words, the ultra wideband antenna unit 10E is similar in structure to the ultra wideband antenna unit 10C illustrated in FIG. 7 except that the antenna element is changed from the antenna element 14B to the antenna element 40.

Although illustration is not made in FIG. 35, the antenna element 40 is mounted on the dielectric substrate 18 (see FIG. 7) in the manner which is shown in FIG. 7. In addition, the illustrated antenna element 40 is disposed on the hinge portion (not shown) of the foldable type mobile telephone set.

Accordingly, as shown in FIG. 35, the antenna element 40 is disposed between the first ground plate 12 and the second ground plate 22 in a state where the foldable type mobile telephone set is opened. In addition, in the example being illustrated, the feeding position d of the feeding point 16 is equal to 16 mm.

Figure 36:
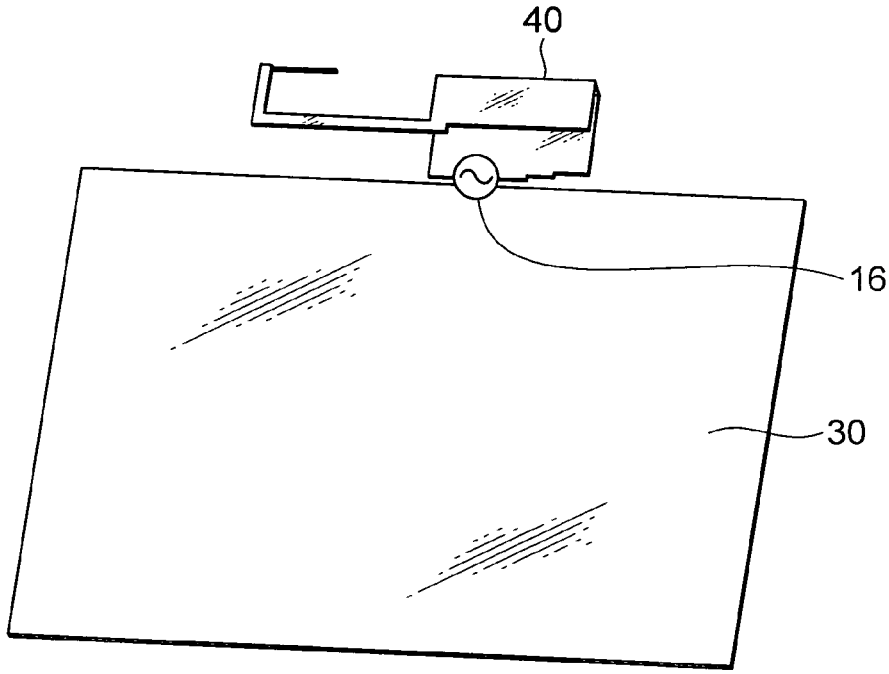
FIG. 36 is a schematic perspective view showing an example where the antenna element for use in the ultra wideband antenna unit according to the third exemplary embodiment of this invention is mounted on a PDA.

While this invention has thus far been described in conjunction with exemplary embodiments thereof, it will now be readily possible for those skilled in the art to put this invention into various other manners. For example, as shown in FIG. 36, the antenna element 40 may be mounted on the personal digital assistant (PDA) 30. In addition, the plate-shaped antenna may not have a rectangular shape. For example, the plate-shaped antenna may be a wideband plate-shape monopole antenna which has a circular shape, a ring shape, a home base shape, a fan shape, or the like.

What is claimed is:

1. An antenna element comprising:

a folded plate-shaped monopole antenna portion having a U-shape in cross section; and an extending portion extending from said folded plate-shaped monopole antenna portion;

wherein said folded plate-shaped monopole antenna comprises:

a first conductive plate having a first length;

a second conductive plate which is disposed in parallel with said first conductive plate and which has a second length shorter than the first length; and a coupling plate for coupling said first conductive plate with said second conductive plate at a first end portion thereof, wherein said extending portion extends from any one of said first conductive plate, said second conductive plate, and said coupling plate, wherein said folded plate-shaped monopole antenna portion has first and second side edges opposite to each other, and wherein said extending portion comprises:

a first extending portion which extends from the second side edge of a tip portion of said second conductive plate in an extending direction where said second conductive plate extends in a longitudinal direction of said second conductive plate;

a second extending portion which is bent from a tip of said first extending portion in a direction at right angles to said first extending portion toward the first end portion on the extending surface where said second conductive plate extends; and a third extending portion which is bent from a tip of said second extending portion in a direction at right angles to said second extending portion and which extends nearer to said coupling plate on an extending surface where said coupling plate extends.

2. The antenna element as claimed in claim 1, wherein said first conductive plate has a notch at a tip portion thereof on the side of the first side edge.

3. The antenna element as claimed in claim 2, wherein said extending portion extends from the second side edge of the tip portion of said second conductive plate on an extending plane where said second conductive plate extends in the longitudinal direction of said second conductive plate.

4. A broadband antenna unit comprising:

a ground plate;

an antenna element disposed in a vicinity of an end of said ground plate; and a dielectric substrate for mounting said antenna element thereon, wherein said antenna element comprises a folded plate-shaped monopole antenna portion having a U-shape in cross section and an extending portion extending from said folded plate-shaped monopole antenna portion, wherein said folded plate-shaped monopole antenna portion comprises:

a first conductive plate having a first length;

a second conductive plate which is disposed in parallel with said first conductive plate and which has a second length shorter than the first length; and a coupling plate for coupling said first conductive plate with said second conductive plate at a first end portion away from said ground plate, wherein said extending portion extends from any one of said first conductive plate, said second conductive plate, and said coupling plate, wherein said folded plate-shape monopole antenna portion has first and second side edges opposite to each other, and wherein said extending portion comprises:

a first extending portion which extends from the second side edge of a tip portion of said second conductive plate in an extending direction where said second conductive plate extends in a longitudinal direction of said second conductive plate;

a second extending portion which is bent from a tip of said first extending portion in a direction at right angles to said first extending portion toward the first end portion on the extending surface where said second conductive plate extends; and a third extending portion which is bent from a tip of said second extending portion in a direction at right angles to said second extending portion and which extends nearer to said coupling plate on an extending surface where said coupling plate extends.

5. The broadband antenna unit as claimed in claim 4, wherein said first conductive plate has a notch at a tip portion thereof on the side of the first side edge.

6. The broadband antenna unit as claimed in claim 5, wherein said extending portion extends from the second side edge of the tip portion of said second conductive plate on an extending plane where said second conductive plate extends in the longitudinal direction of said second conductive plate.

7. A broadband antenna unit comprising:

a first ground plate;

a second ground plate;

an antenna element disposed between said first ground plate and said second ground plate in the vicinity of an end of said ground plate; and a dielectric substrate for mounting said antenna element thereon, wherein said antenna element comprises:

a folded plate-shaped monopole antenna portion having a U-shape in cross section; and an extending portion extending from said folded plate-shaped monopole antenna portion, wherein said folded plate-shaped monopole antenna Portion comprises:

a first conductive plate having a first length;

a second conductive plate which is disposed in parallel with said first conductive plate and which has a second length shorter than the first length; and a coupling plate for coupling said first conductive plate with said second conductive plate at a first end Portion away from said first ground plate, wherein said extending portion extends from any one of said first conductive plate, said second conductive plate, and said coupling plate, wherein said folded plate-shape monopole antenna portion has first and second side edges opposite to each other, and wherein said extending portion comprises:

a first extending portion which extends from the second side edge of a tip portion of said second conductive plate in an extending direction where said second conductive plate extends in a longitudinal direction of said second conductive plate;

a second extending portion which is bent from a tip of said first extending portion in a direction at right angles to said first extending portion toward the first end portion on the extending surface where said second conductive plate extends; and a third extending portion which is bent from a tip of said second extending portion in a direction at right angles to said second extending portion and which extends nearer to said coupling plate on an extending surface where said coupling plate extends.

8. The broadband antenna unit as claimed in claim 7, wherein said first conductive plate has a notch at a tip portion thereof on the side of the first side edge.

9. The broadband antenna unit as claimed in claim 8, wherein said extending portion extends from the second side edge of the tip portion of said second conductive plate on an extending plane where said second conductive plate extends in the longitudinal direction of said second conductive plate.

* * * * *